US011897016B2

(12) United States Patent
Wurmfeld

(10) Patent No.: US 11,897,016 B2
(45) Date of Patent: Feb. 13, 2024

(54) APPARATUS AND METHOD OF SHAPING METAL PRODUCT

(71) Applicant: CAPITAL ONE SERVICES LLC, McLean, VA (US)

(72) Inventor: David Kelly Wurmfeld, Fairfax, VA (US)

(73) Assignee: Capital One Services, LLC, McLean, VA (US)

( * ) Notice: Subject to any disclaimer, the term of this patent is extended or adjusted under 35 U.S.C. 154(b) by 0 days.

(21) Appl. No.: 17/733,584

(22) Filed: Apr. 29, 2022

(65) Prior Publication Data

US 2022/0331854 A1 Oct. 20, 2022

Related U.S. Application Data

(63) Continuation of application No. 16/655,097, filed on Oct. 16, 2019, now Pat. No. 11,325,175, which is a continuation of application No. 16/161,673, filed on Oct. 16, 2018, now Pat. No. 10,478,885, which is a continuation of application No. 16/158,090, filed on Oct. 11, 2018, now Pat. No. 10,589,335.

(51) Int. Cl.

| | |
|---|---|
| ***B21D 26/041*** | (2011.01) |
| ***B21D 26/047*** | (2011.01) |
| ***B21D 26/043*** | (2011.01) |
| ***B21D 26/039*** | (2011.01) |
| ***B21D 26/027*** | (2011.01) |

(52) U.S. Cl.

CPC ..... *B21D 26/041* (2013.01); *B21D 26/027* (2013.01); *B21D 26/039* (2013.01); *B21D 26/043* (2013.01); *B21D 26/047* (2013.01)

(58) Field of Classification Search

CPC .. B21D 26/027; B21D 26/029; B21D 26/039; B21D 26/041; B21D 26/047; Y10T 29/49805; C21D 1/46

See application file for complete search history.

(56) References Cited

U.S. PATENT DOCUMENTS

| | | | |
|---|---|---|---|
| 2,689,578 | A | 9/1954 | Lyon |
| 2,762,734 | A | 9/1956 | Corral |
| 2,816,849 | A | 12/1957 | Ankersen |
| 3,055,104 | A | 9/1962 | Lyon |
| 3,066,629 | A | 12/1962 | Lyon |
| 3,339,387 | A | 9/1967 | Myers |
| 3,358,489 | A | 12/1967 | Hutchins |

(Continued)

FOREIGN PATENT DOCUMENTS

| | | | |
|---|---|---|---|
| DE | 10 2006 035 239 | B3 | 6/2007 |
| GB | 1251488 | A | 8/1970 |

(Continued)

OTHER PUBLICATIONS

WO 01/87568A1, Ziegler Nov. 2001.*
DE 102006046305A1, Trubert et al. Apr. 2008.*

*Primary Examiner* — Edward T Tolan
(74) *Attorney, Agent, or Firm* — Perkins Coie LLP

(57) ABSTRACT

A method for shaping a blank comprising a metal includes a step of loading die blank onto a first die, a step of bringing the first die and a second die together, a step of forming a seal around the blank, and a step of injecting a pressurized molten salt into a space in die blank to supply a hydraulic pressure to the blank.

20 Claims, 31 Drawing Sheets

(56) References Cited

U.S. PATENT DOCUMENTS

| | | | | |
|---|---|---|---|---|
| 3,487,668 | A | 1/1970 | Fuchs, Jr. | |
| 3,529,457 | A | 9/1970 | Bowers | |
| 3,797,294 | A * | 3/1974 | Roth | B21D 26/12 72/63 |
| 3,952,406 | A * | 4/1976 | Madsen | H02K 3/48 310/43 |
| 4,049,184 | A | 9/1977 | Rozengart | |
| 4,343,169 | A | 8/1982 | Moreau | |
| 4,667,497 | A | 5/1987 | Oslin | |
| 5,326,409 | A | 7/1994 | Couts, Jr. | |
| 6,613,164 | B2 | 9/2003 | Dykstra | |
| 7,266,982 | B1 | 9/2007 | Guza | |
| 8,528,376 | B2 | 9/2013 | Li | |
| 2001/0037573 | A1 | 11/2001 | Kuschel | |
| 2004/0255630 | A1 | 12/2004 | Rager | |

FOREIGN PATENT DOCUMENTS

| | | |
|---|---|---|
| JP | 59-147721 | 8/1984 |
| JP | 62-54528 | 3/1987 |

* cited by examiner

APPARATUS AND METHOD OF SHAPING METAL PRODUCT

CROSS-REFERENCE TO RELATED APPLICATIONS

This application is a continuation of U.S. application Ser. No. 16/655,097, filed Oct. 16, 2019, which is a continuation of U.S. application Ser. No. 16/161,673, filed Oct. 16, 2018, now issued as U.S. Pat. No. 10,478,885, which is a continuation of U.S. application Ser. No. 16/158,090, filed Oct. 11, 2018, now issued as U.S. Pat. No. 10,589,335. The above-referenced applications are expressly incorporated herein by reference in their entireties.

TECHNICAL FIELD

Apparatus, methods, and devices consistent with the present disclosure relate to the field of hydroforming, and more particularly, a hydroforming method for forming a metal product using pressurized molten salt.

BACKGROUND

One of the methods used to form metal products such as body parts of a vehicle is hydroforming. Hydroforming uses a high-pressure hydraulic fluid to press a working material or a blank in a sheet form or a lube form to contact a die. The use of pressurized fluid to press the blank allows hydroforming to form complex shapes with concavities. The hydroforming method is suitable for shaping many metals such as steel, stainless steel, copper, aluminum, brass, and various alloys, and the process is generally cost-effective. Because of work hardening resultant from the forming deformations, hydroformed parts have higher stiffness-to-weight ratios than traditional die stamped parts. Unfortunately, some metals, especially high strength metal alloy products such as titanium, aluminum, and nickel alloy products, formed using conventional hydroforming method may become more brittle as a result of tire work hardening during hydroforming, and as a result suffer from increased crack formation and propagation. Thus, there is a demand for apparatus and methods that can reduce or avoid embrittlement while still obtaining the forming benefits of hydroforming.

SUMMARY

According to one exemplary embodiment of the present disclosure, there is provided a method of shaping a metal. The method includes a step of pre-heating a blank made of foe metal by thermal energy provided by a reservoir of molten salt, a step of loading the blank on a first die of a hydroforming apparatus, a step of bringing the first die and a second die of the hydroforming apparatus together and scaling the blank, and a step of injecting a pressurized molten salt into a space in the blank to supply a hydraulic pressure to the blank.

The step of injecting a pressurized molten salt further includes a step of supplying a solid salt to a hydraulic cylinder, a step of turning on a heater in the hydraulic cylinder to melt the solid salt to form the molten salt, and a step of pressurizing and pumping (the molten salt.

The method further includes monitoring and controlling a temperature of the molten salt to maintain the temperature within 100° C. of a deformation temperature of the metal. The deformation temperature of the metal may be a temperature at which the metal begins to lose strength, or a temperature at which a homologous temperature of the metal is between 0.3 to 0.6. The method may also include monitoring and controlling a temperature of the molten salt to maintain the temperature within 50° C. of a deformation temperature of the metal.

In the method, the metal may be any metal alloy having low formability, and may be selected from the group consisting of steel, titanium, nickel, aluminum, magnesium, and alloys thereof.

In the method, the salt may be at least one of chloride salt, fluoride salt, cryolite salt, hydroxide salt, nitrate salt, or cyanide salt.

The method further includes heating the blank by a heater disposed in at least one of the first and second dies of the hydroforming apparatus.

The method further includes monitoring and controlling a pressure of the molten salt.

In the method, the blank may be a tube made of the metal or a sheet made of the metal. The blank may have any kind of shapes and may be made of the metal.

According to another exemplary embodiment of the present disclosure, there is provided an apparatus for shaping a metal, the apparatus including a first die and a second die that seal a blank made of the metal therebetween; at least one hydraulic cylinder configured to supply a pressurized molten salt to a space in the blank to provide a hydraulic pressure to die blank; and at least one reservoir of molten salt configured to store molten salt and to provide thermal energy to the blank to pre-heat the blank.

In the apparatus, the hydraulic cylinder may include a heater that heats a solid salt to form a molten salt. The heater may be at least one of a resistive heating coil or cable, a furnace, a radiant heater such as an infrared heater, or a laser heater.

The hydraulic cylinder further includes a temperature controller configured to monitor, display and control a temperature of the molten salt, and a pressure controller configured to monitor, display and control a pressure of the pressurized molten salt.

The apparatus further includes a salt container that provides the solid salt through a valve connecting the salt container and the hydraulic cylinder, and a heater installed in at least one of the first die and the second die to provide heat to the blank.

According to yet another exemplary embodiment of the present disclosure, there is provided a metal product that is formed by a step of pre-heating a blank made of the metal, a step of loading the blank on a first die of a hydroforming apparatus, a step of bringing the first die and a second die of the hydroforming apparatus together to seal the blank, and a step of injecting a pressurized molten salt into a space in the blank to supply a hydraulic pressure to the blank.

The metal may be any metal alloy having low formability, for example, having a formability lower than that of steel, and may be selected from a group consisting of steel, titanium, nickel, aluminum, magnesium, and alloys thereof.

The salt may be at least one of chloride salt, fluoride salt, cryolite salt, hydroxide salt, nitrate salt, or cyanide salt.

The molten salt may be maintained at a temperature within 100° C. of a deformation temperature of the metal. For example, the molten salt may be maintained at a temperature within 50° C. of a deformation temperature of the metal.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the invention. Instead, they are merely examples of apparatuses and methods consistent with aspects related to the invention as recited in the appended claims.

First Embodiment

Figure 1:
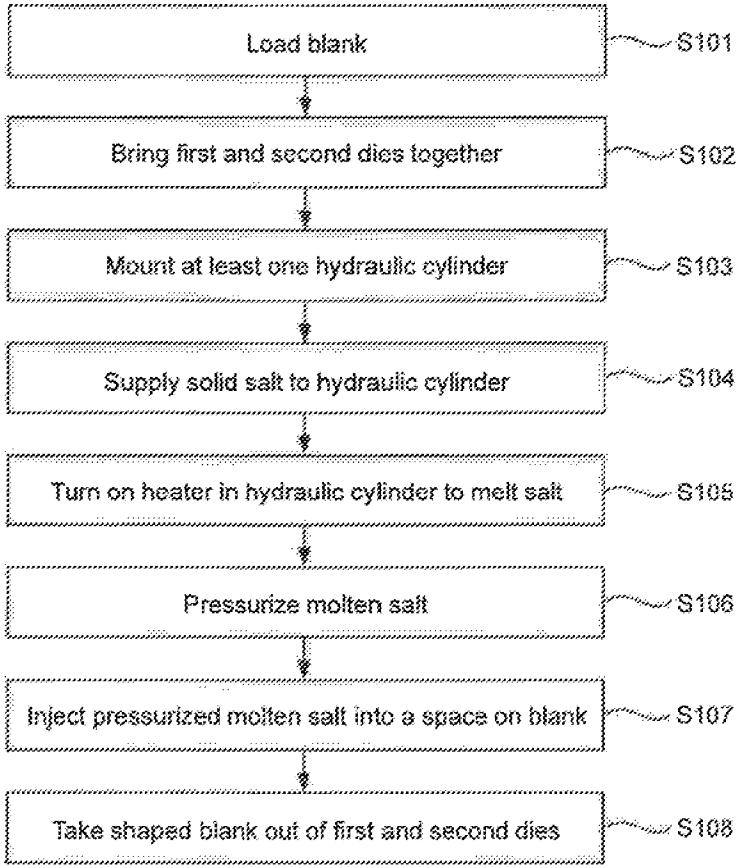
FIG. 1 is a flowchart indicating a method of shaping a metal, consistent with an embodiment of the present disclosure.

References are now made to FIG. 1, a flowchart indicating a method of shaping a metal, consistent with exemplary embodiments of the present disclosure. FIG. 1 shows a step S101 of loading a blank which is a sheet blank or a tube blank or a blank of any shape that is used to form another shape. The blank is made of a metal or metal alloy. After loading the blank in step S101, first and second dies are brought together in a step S102. Then, in a step S103, at least one hydraulic cylinder is mounted to the assembly of the dies. After that, salt is supplied to the hydraulic cylinder in a step S104. In a step S105, the heater in the hydraulic cylinder is turned on, and the salt supplied to the hydraulic cylinder is melted. In a step S106, tire molten salt is pressurized. The pressurized molten salt is injected by the pump through the hydraulic cylinder into a space in blank in a step S107. During this process, the blank is pressed against inner surfaces of dies 210 and 220, and completely contacts the dies. Then, in a step S108, the shaped blank is taken out of the dies. Generally, before the loading m step S101, in order to save energy, the blank is pre-heated by placing the blank onto a surface of a reservoir storing the molten salt.

Figure 2:
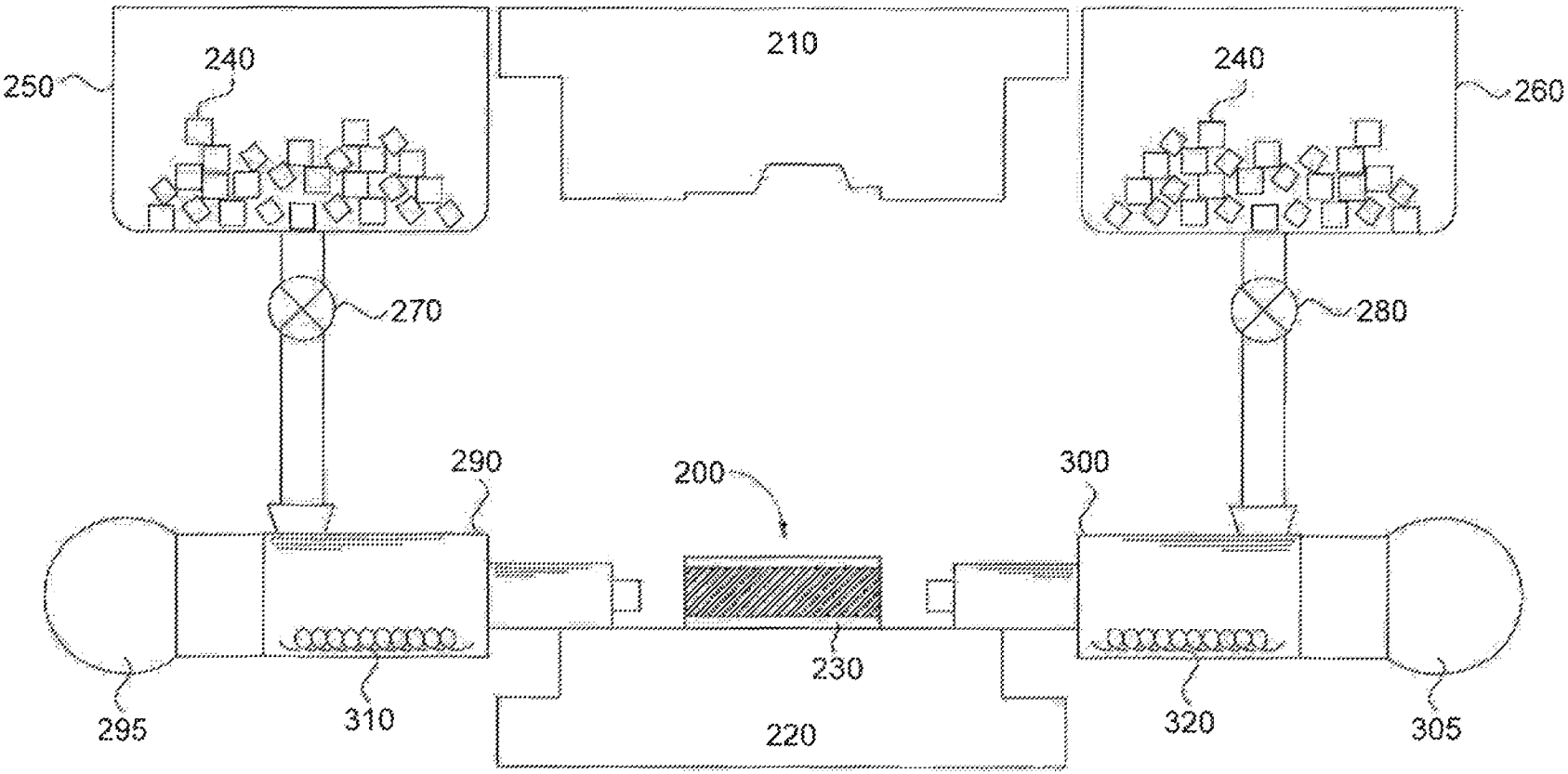
FIG. 2 is a schematic cross-sectional diagram of an apparatus for shaping a metal, corresponding to step S101 of the flowchart of FIG. 1, consistent with an embodiment of the present disclosure.

FIG. 2 illustrates an exemplary hydroforming apparatus to implement the method of FIG. 1. As shown in FIG. 2, the hydroforming apparatus includes a First die 220, a second die 210, salt containers 250 and 260 containing solid salt 240, valves 270 and 280, hydraulic cylinders 290 and 300, pumps 295 and 305, and heaters 310 and 320, in some embodiments of the present disclosure. Valves 270 and 280 control the passage of salt from salt containers 250 and 260 to hydraulic cylinders 290 and 300. Valves 270 and 280 may be manual valves such as ball valves, butterfly valves, globe valves, gate valves, diaphragm valves, or electromechanical valves such as solenoid valves, and robotic valves.

Sail containers 250 and 260 are made of a material that is not corroded by salt, such as stainless steel, ceramics, and glass. Salt containers 250 and 260 in FIG. 1 do not contain any heater and the solid salt crystals pass through a tube controlled by valves 270 and 280 to the interior of hydraulic cylinders 290 and 300, respectively.

Each of hydraulic cylinders 290 and 300 includes a heater 310 and 320, respectively, for heating solid salt crystals in hydraulic cylinders 290 and 300 passed from the salt containers 250 and 260. Each of hydraulic cylinders 290 and 300 includes a pump 295 and 305, respectively. The pumps function to pressurize the molten salt inside hydraulic cylinders 290 and 300. Due to the action pumps 295 and 305, the molten salt becomes pressurized, and hydraulic cylinders 290 and 300 inject the molten salt into a space in a blank 230 loaded onto a First die 220, which has been put in place by a loading mechanism 200. Pumps 295 and 305 may be rotary lobe pumps, progressing cavity pumps, rotary gear pumps, piston pumps, diaphragm pumps, screw pumps, gear pumps, vane pumps, etc. First die 220 and a second die 210 function to shape blank 230 by being pressed together. The hydraulic cylinders 290 and 300 may serve as reservoirs of molten salt such that blanks placed onto surfaces of the reservoirs can be pre-heated by thermal energy of the molten salt. Alternatively, the apparatus may include an additional reservoir of the molten salt.

The process as shown in FIG. 2 corresponds to step S101 in the exemplary flowchart of FIG. 1. As shown in FIG. 1 and FIG. 2, in stop S101, blank 230 is leaded onto first die 220 by a loading mechanism 200. The loading mechanism may be a robotic arm or a lever system. In FIG. 2, blank 230 is in the form of a tube. However, the blank is not limited to a tube, it can be in a form of a sheet or a blank with any shape that is used to form another shape.

Blank 230 is made of a metal. The metal may be any metal or metal alloy having low formability. The metal may be selected from the group consisting of steel, titanium, nickel, aluminum, magnesium, and alloys thereof.

Figure 3:
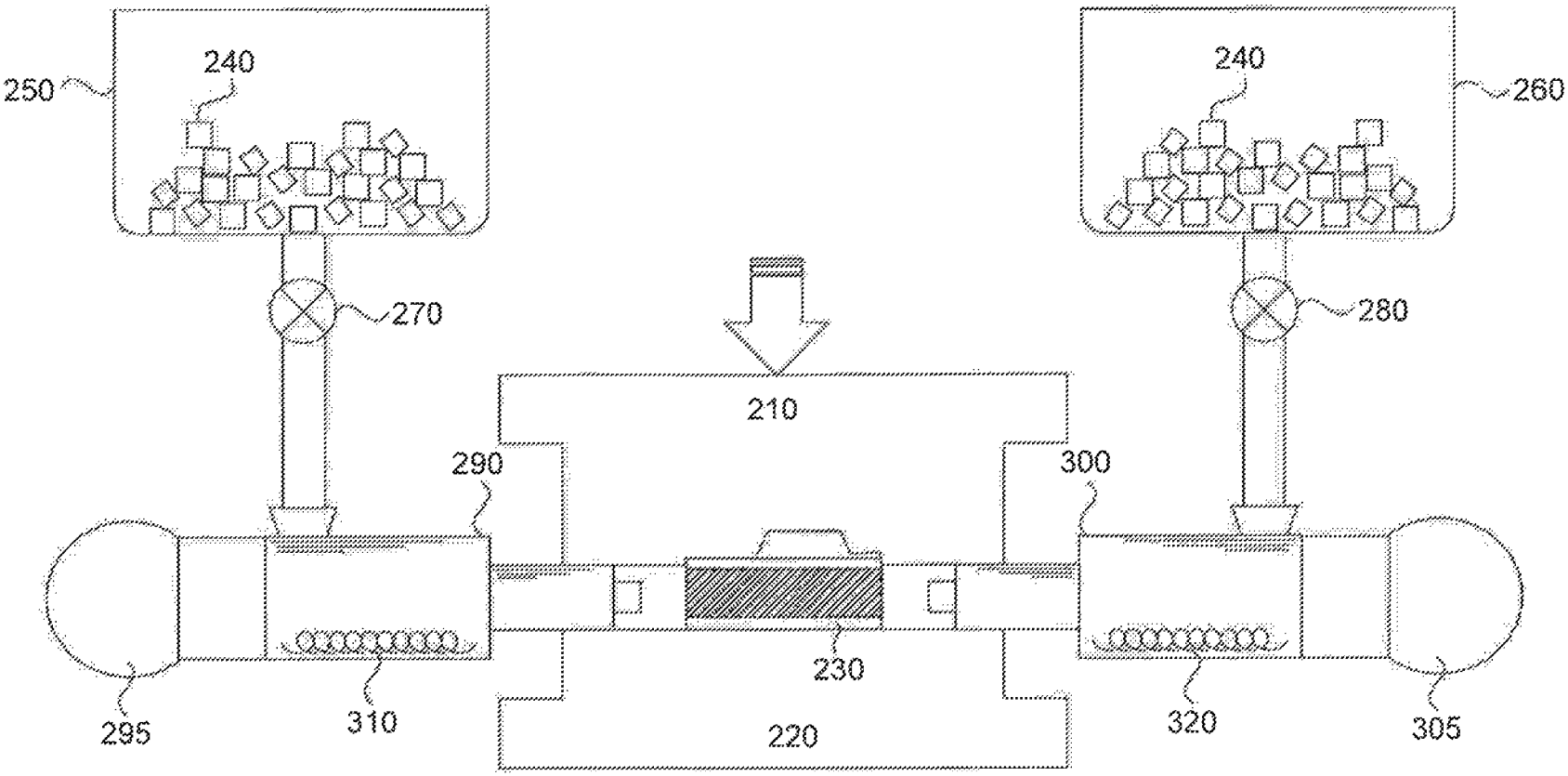
FIG. 3 is a cross-sectional diagram of the apparatus for shaping a metal, corresponding to step S102 of the flowchart of FIG. 1, consistent with an embodiment of the present disclosure.

Reference is now made to FIG. 3, a cross-sectional diagram of the apparatus for shaping a metal, corresponding to step S102 of the exemplary method of FIG. 1. As shown in FIG. 1 and FIG. 3, after loading blank 230 in step S101, first die 220 and second die 210 are brought together in step S102 to seal blank 230 therebetween. In FIG. 3, since first die 220 is stabilized on the floor, only second die 210 is moved, by being brought downward (along the direction indicated by a block arrow in FIG. 3) toward first die 220, in some embodiments of the present disclosure. In other embodiments, both first die 220 and second die 210 may be moved, as they are being brought toward each oilier. A force is then applied to press the blank, in some embodiments of the present disclosure. In some embodiments, no force is applied to blank 230 and first and second dies 220 and 210 are positioned to a pre-set position for subsequent processes, while still forming a seal around blank 230.

Figure 4:
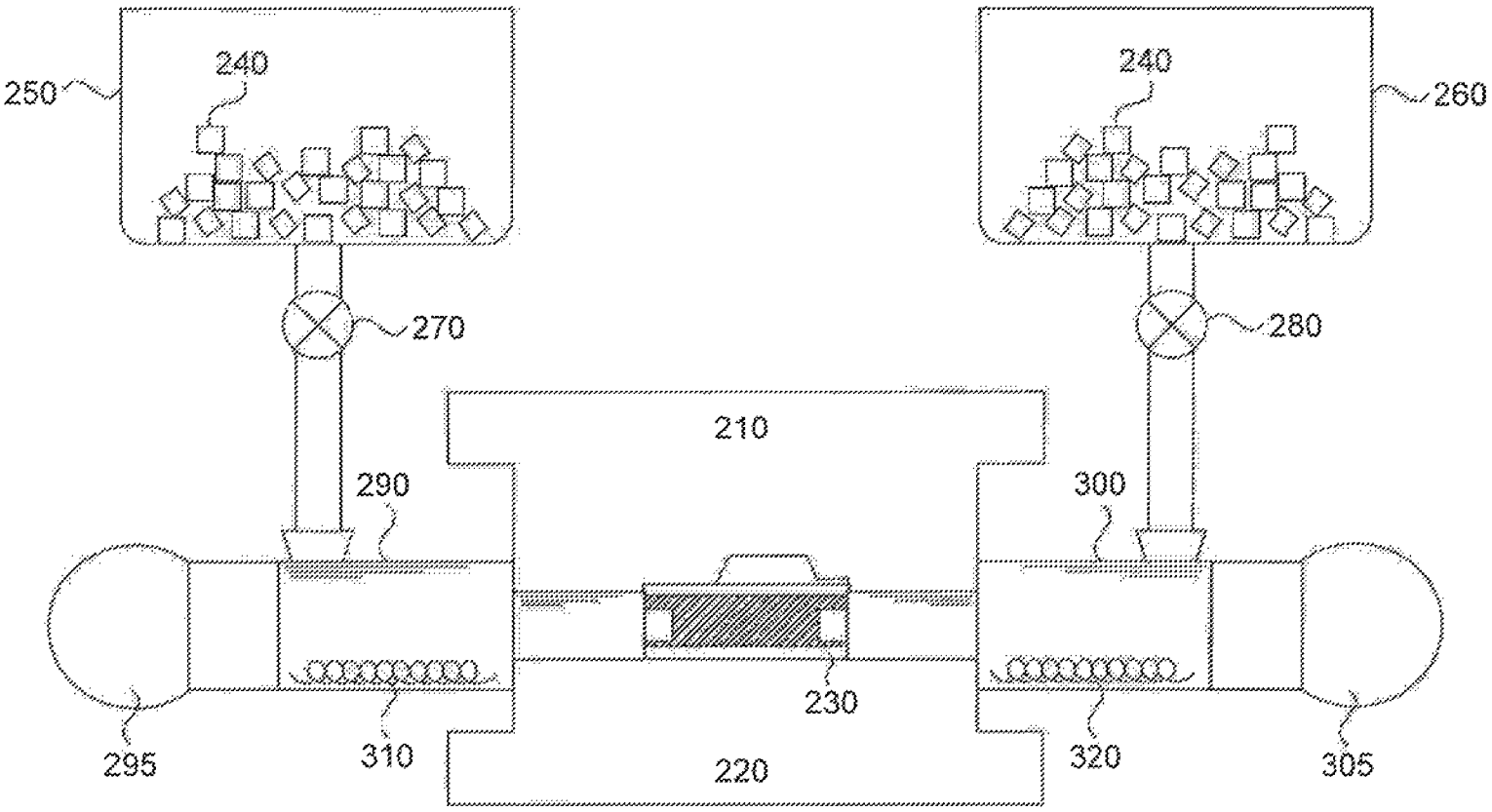
FIG. 4 is a cross-sectional diagram of the apparatus for shaping a metal, corresponding to step S103 of the flowchart of FIG. 1, consistent with an embodiment of the present disclosure.

Reference is now made to FIG. 4, a cross-sectional diagram of the apparatus for shaping a metal, corresponding to step S103 of the flowchart of FIG. 1, consistent with an embodiment of the present disclosure. As shown in FIG. 1 and FIG. 4, in step S103, two hydraulic cylinders 290 and 300 are mounted to both sides of the assembly of dies 210 and 220. In this embodiment, hydraulic cylinder 290 includes a heater 310, and hydraulic cylinder 300 includes a heater 320. In another embodiment, only one of hydraulic cylinders 290 and 300 is mounted to either side of the assembly of dies 210 and 220.

Heaters 310 and 320 may be any type of heater that provides thermal energy, for example, a resistive heating coil or cable, furnace, radiant heater such as an infrared heater, and a laser heater, consistent with one or more exemplary embodiments of the present disclosure. Heaters 310 and 320 are connected to a controller that monitors, displays and controls temperatures of heaters 310 and 320, consistent with exemplary embodiments of the present disclosure. Pumps 295 and 305 may be connected to hydraulic cylinders 290 and 300 respectively.

Figure 5:
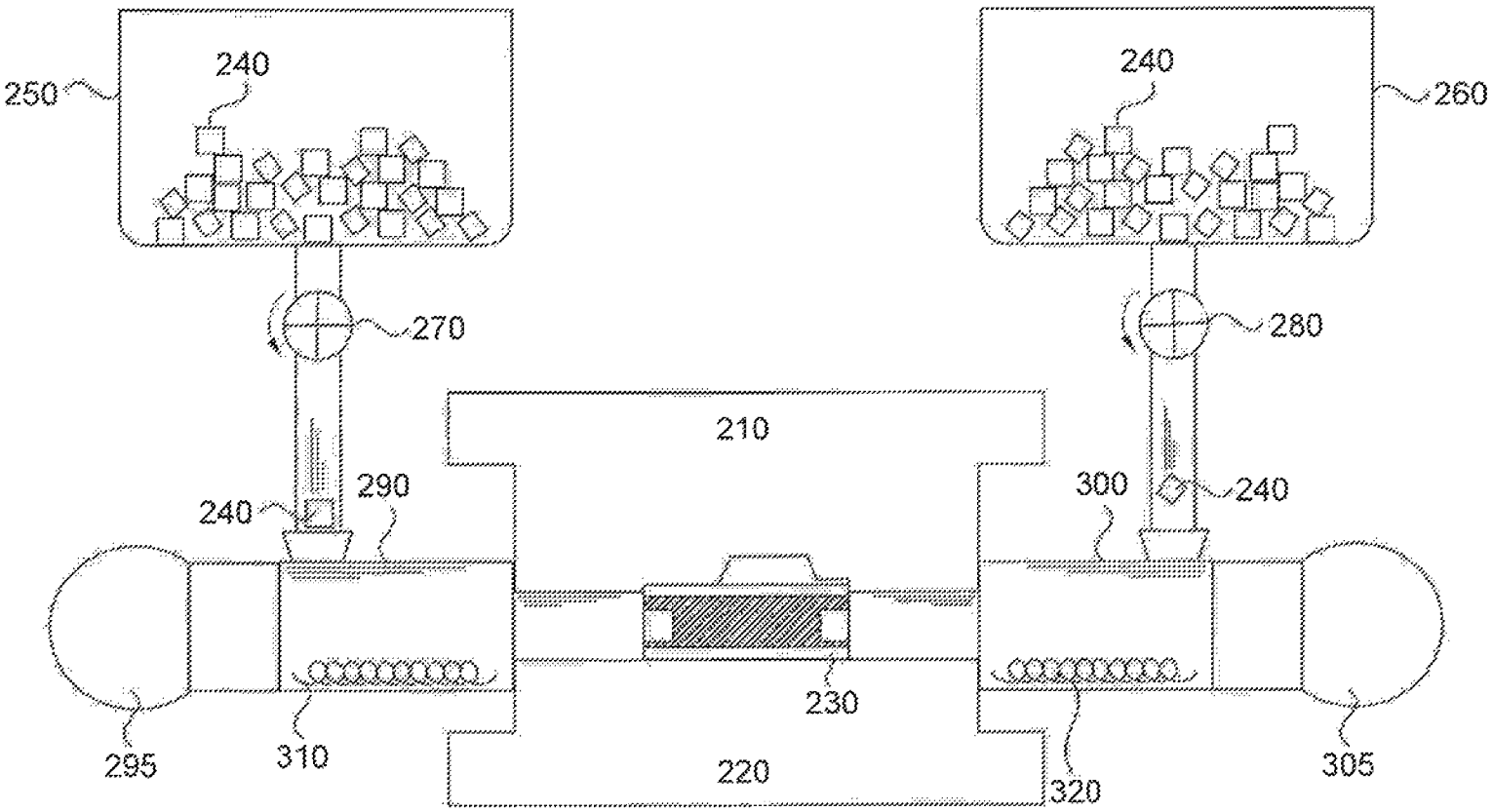
FIG. 5 is a cross-sectional diagram of the apparatus for shaping a metal, corresponding to step S104 of the flowchart of FIG. 1, consistent with an embodiment of the present disclosure.

Reference is now made to FIG. 5, a cross-sectional diagram of exemplary apparatus for shaping a metal, corresponding to step S104 of the flowchart of FIG. 1, consistent with an embodiment of the present disclosure. As shown in FIG. 1 and FIG. 5, solid salt is supplied to hydraulic cylinders 290 and 300 in step S104. In this embodiment, the salt is contained in containers 250 and 260 positioned on the tops of hydraulic cylinders 290 and 300, and transferred to hydraulic cylinders 290 and 300 by opening valves 270 and 280 that connect containers 250 and 260 to hydraulic cylinders 290 and 300, respectively. In another embodiment, containers 250 and 260 are positioned on the same level as hydraulic cylinders 290 and 300, and the salt is transferred to the cylinders by any automatic transferring mechanisms, for example, by belt transfer.

Figure 6:
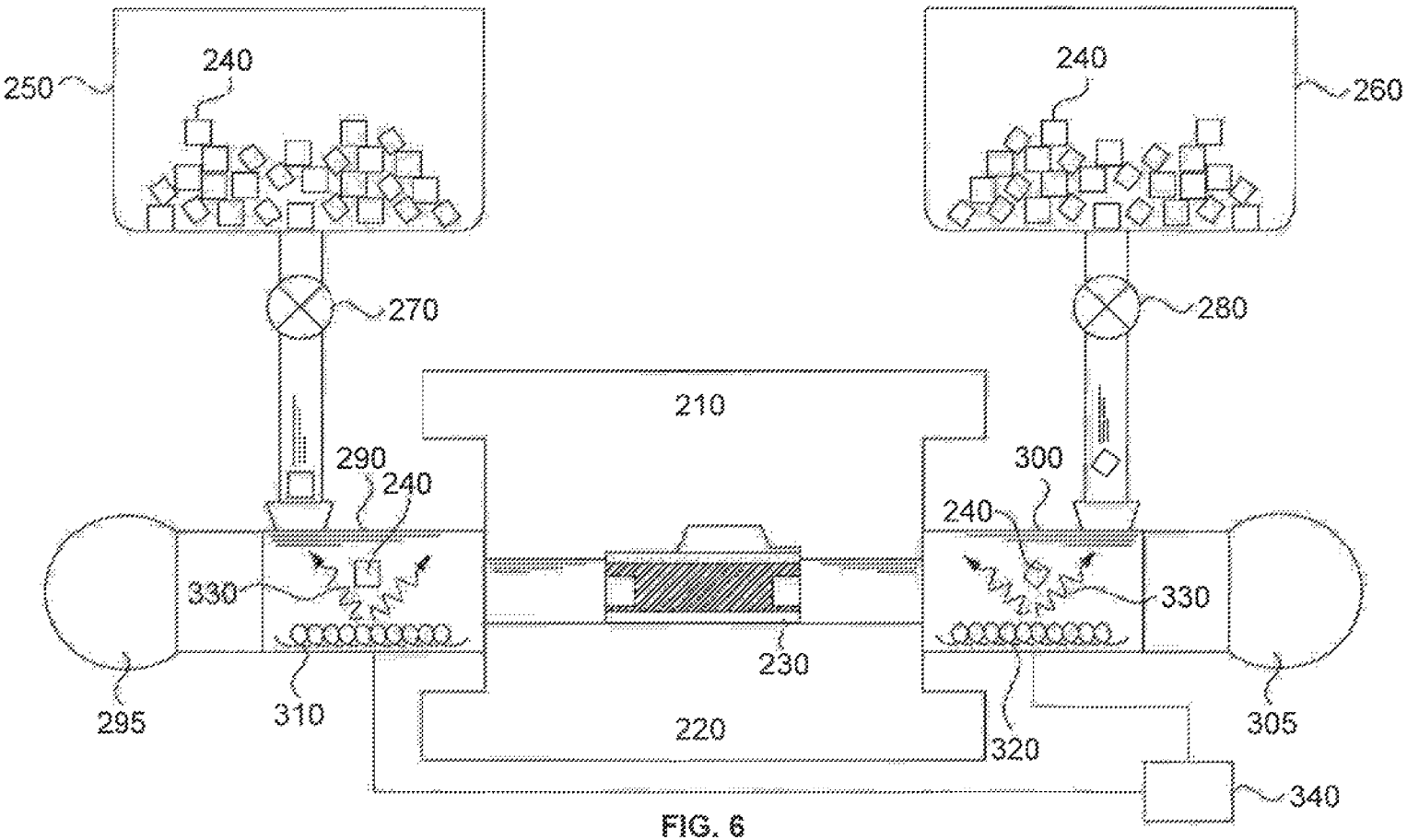
FIG. 6 is a cross-sectional diagram of die apparatus for shaping a metal, corresponding to step S105 of the flowchart of FIG. 1, consistent with an embodiment of the present disclosure.

Reference is now made to FIG. 6, a cross-sectional diagram of the apparatus for shaping a metal, corresponding to step S105 of the flowchart of FIG. 1, consistent with an embodiment of the present disclosure. As shown in FIG. 1 and FIG. 6, in step S105, heaters 310 and 320 in hydraulic cylinders 290 and 300 are turned on, and the salt supplied to the hydraulic cylinders is melted. More specifically, in FIG. 6, controller 340 applies electrical current to heaters 310 and 330 which heat up salt crystals 240 to form a molten salt.

The salt may be at least ORO of chloride salt, fluoride cryolite salt hydroxide salt, nitrate salt, or cyanide salt. The temperature of the heaters is controlled based on a melting temperature of the salt, so that the thermal energy provided by the heaters is sufficient to form a molten salt. A simple example of a salt is sodium chloride ("table salt") which has a melting temperature of 801° C. The molten salt is a stable liquid and flows much like water does. The significant difference between the molten salt and water is that the much higher temperatures attainable in the molten salt state provides heat to blank 230 soften the blank, which may provide a successful forming process without crack formation.

In some embodiments, a temperature of the molten salt is maintained within 100° C. of a deformation temperature of the metal of blank 230. The deformation temperature of the metal blank may be a temperature at which the metal blank begins to lose strength, or a temperature at which a homologous temperature of the metal blank is ranged between 0.3 to 0.6, Selection of a salt is based on a melting temperature of the ash such that the melting temperature of the salt does not exceed the deformation temperature of the metal blank. In other embodiments, a temperature of the molten salt is maintained within 50° C. of a deformation temperature of the metal of blank 230.

Figure 7:
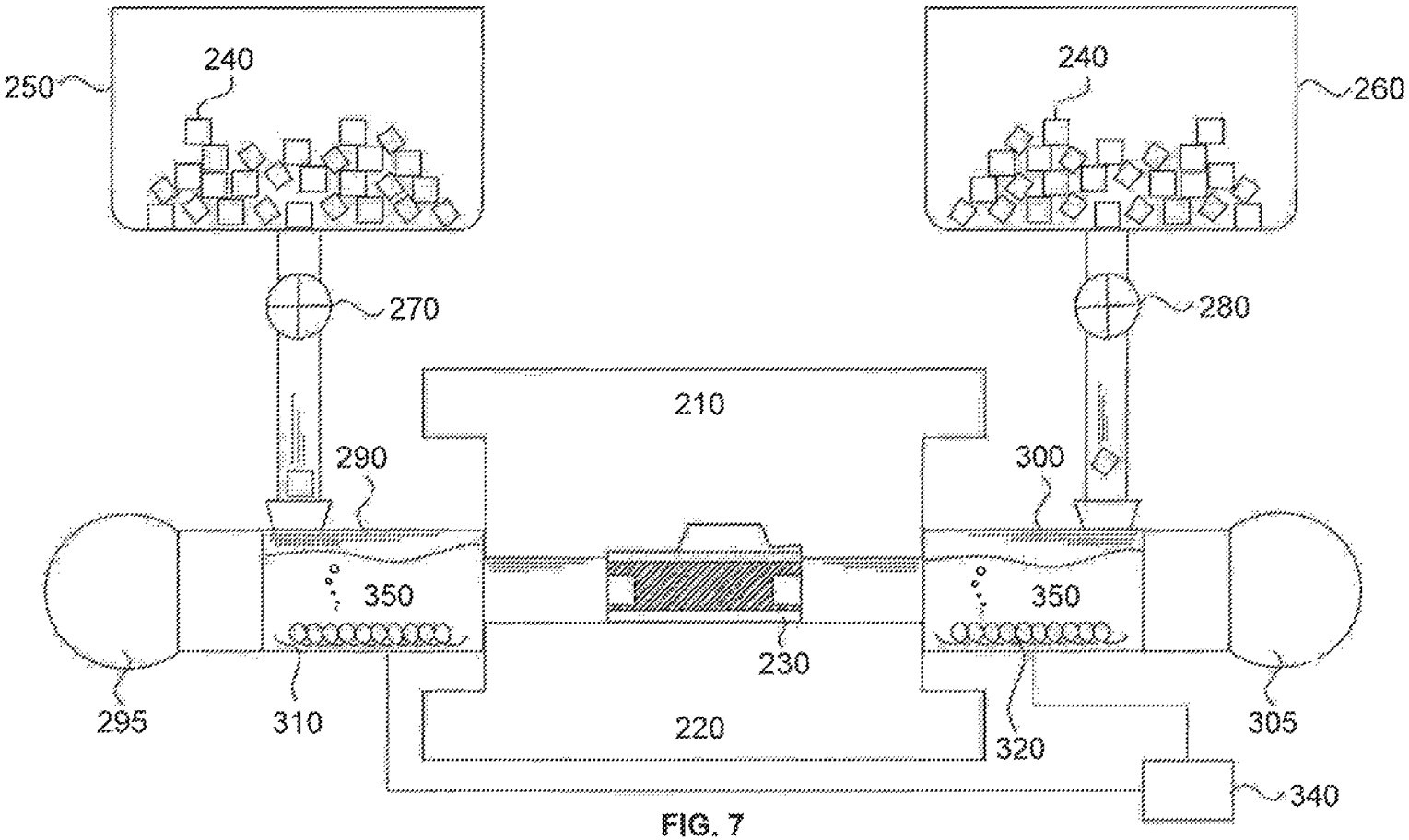
FIG. 7 is a cross-sectional diagram of the apparatus for shaping u metal, corresponding to step S106 of the flowchart of FIG. 1, consistent with an embodiment of the present disclosure.

Reference is now made to HO, 7, a cross-sectional diagram of exemplary apparatus for shaping a metal, corresponding to step S106 of the flowchart of FIG. 1, consistent with an embodiment of the present disclosure. As shown in FIG. and FIG. 7, in step S106, the molten salt inside hydraulic cylinders 290 and 300 is pressurized by pumps 295 and 305. At least one of hydraulic cylinders 290 and 300 farther includes pressure controller configured to monitor, display and control a pressure of the molten salt.

Figure 8:
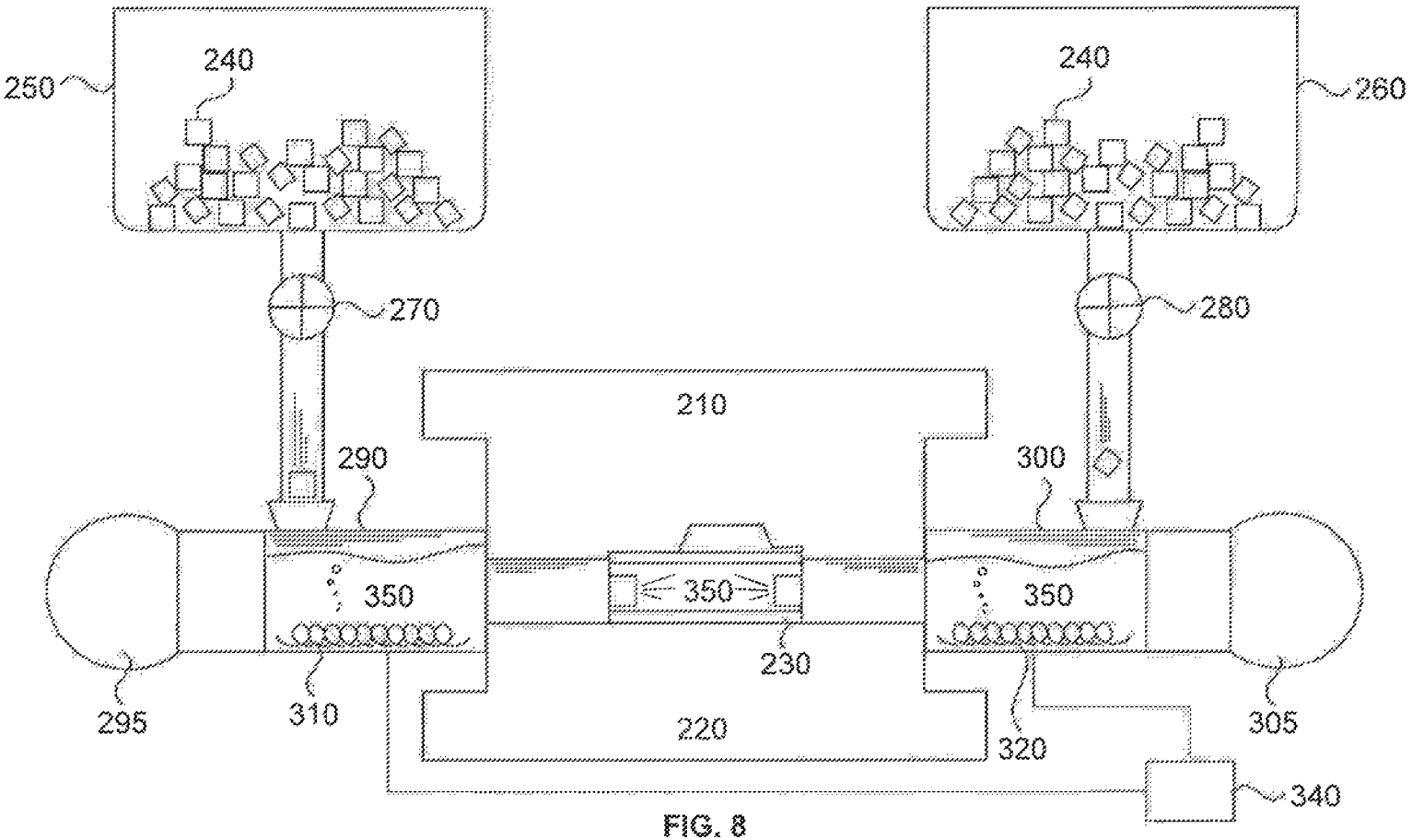
FIG. 8 is a cross-sectional diagram of the apparatus for shaping a metal, corresponding to a partial situation of a step S107 of the flowchart of FIG. 3, consistent with an embodiment of the present disclosure.

Reference is now made to FIG. 8, a cross-sectional diagram of exemplary apparatus for shaping a metal, corresponding to a partial situation of a step S107 of the flowchart of FIG. 1. As shown m FIG. 1 and FIG. 8, in step S107, pressurized molten salt 350 is injected by pumps 295 and 305 into a space in blank 230, sealed between first and second dies 210 and 220. For a blank of a tube form, the space is the interior space of the tube blank. For a blank of a sheet form, the space is a space on the sheet blank. During this process, the heat provided by the molten salt softens blank 230.

Figure 9:
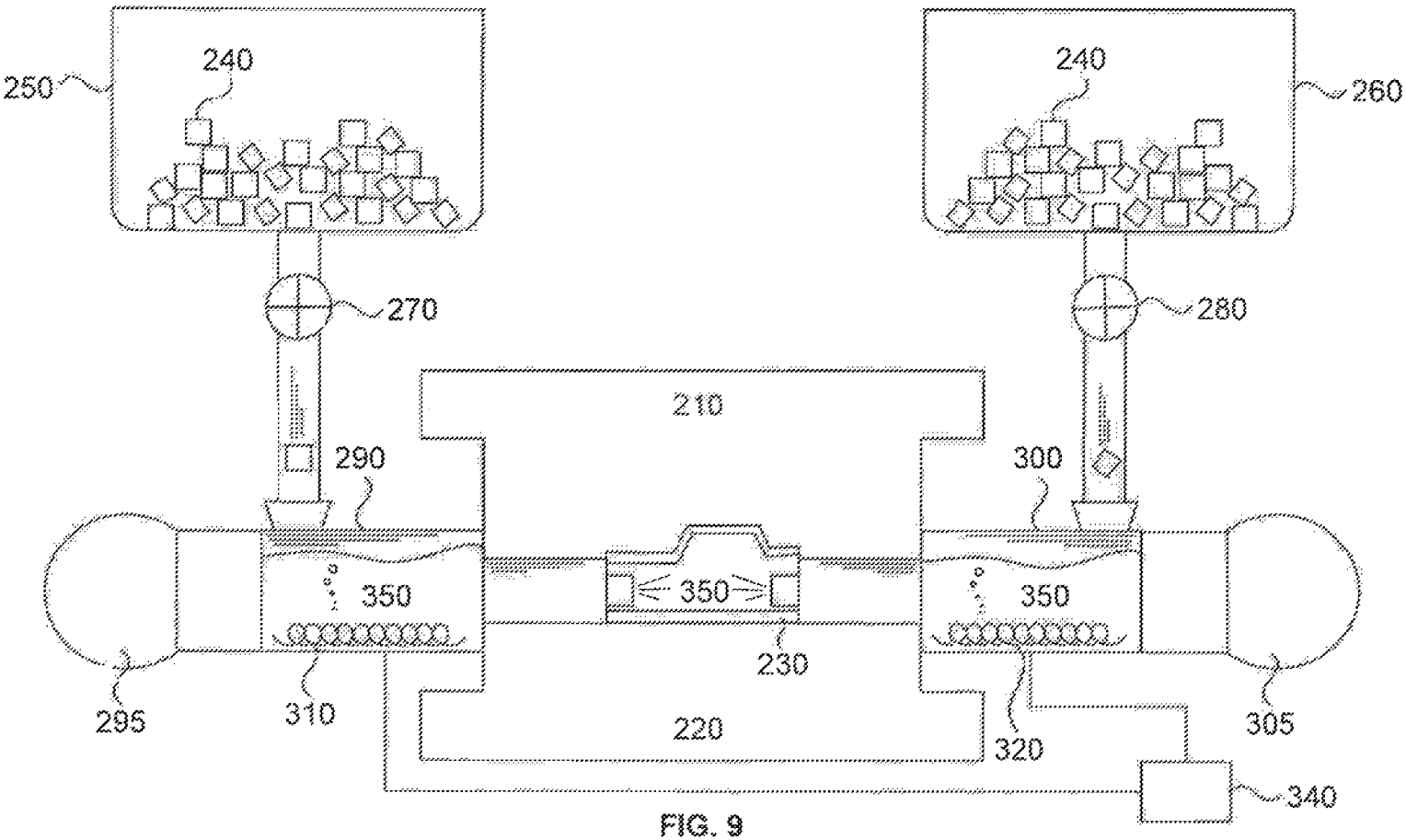
FIG. 9 is a cross-sectional diagram of the apparatus for shaping a metal, corresponding to a partial situation of a step S107 of the flowchart of FIG. 1, consistent with an embodiment of the present disclosure.

Reference is now made to FIG. 9, a cross-sectional diagram of exemplary apparatus for shaping a metal, corresponding to a partial situation of a step S107 of the flowchart of FIG. 1. As shown in, FIG. 1 and FIG. 9, in step S107, because of the seal formed around blank 230, the in pressurized molten salt presses the blank into contact with dies 210 and 220. In this way, the shaping of blank 230 is carried out.

Figure 10:
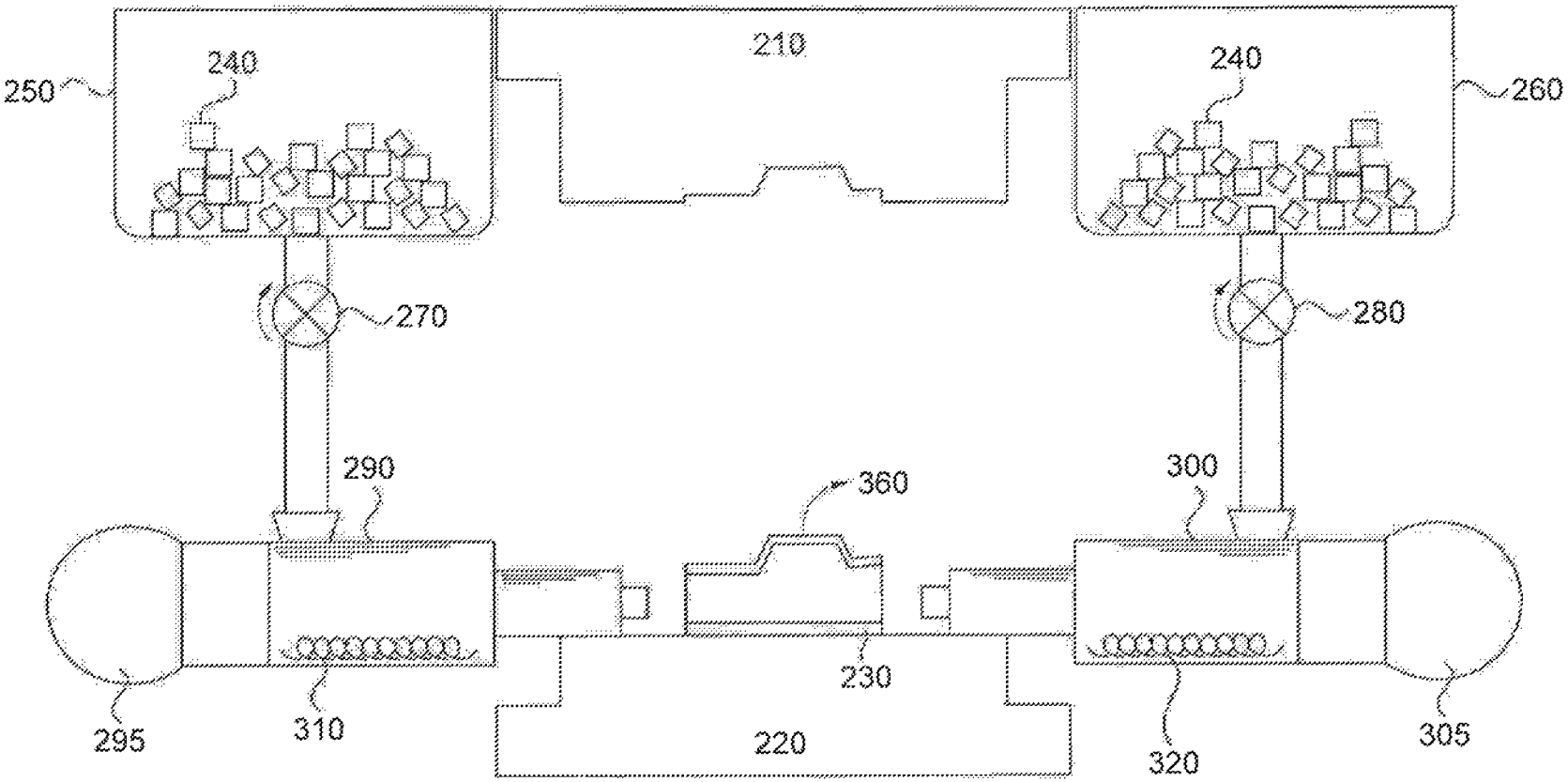
FIG. 10 is a cross-sectional diagram of the apparatus for shaping a metal, corresponding to step S108 of the flowchart of FIG. 1, consistent with an embodiment of the present disclosure.

Reference is now made to FIG. 10, a cross-sectional diagram of exemplary apparatus for shaping a metal, corresponding to step S108 of the flowchart FIG. 1. As shown in FIG. 1 and FIG. 10, in step S108, dies 210 and 220 are moved away front each other and the shaped blank 360 is taken from the dies 210 and 220.

Second Embodiment

Figure 11:
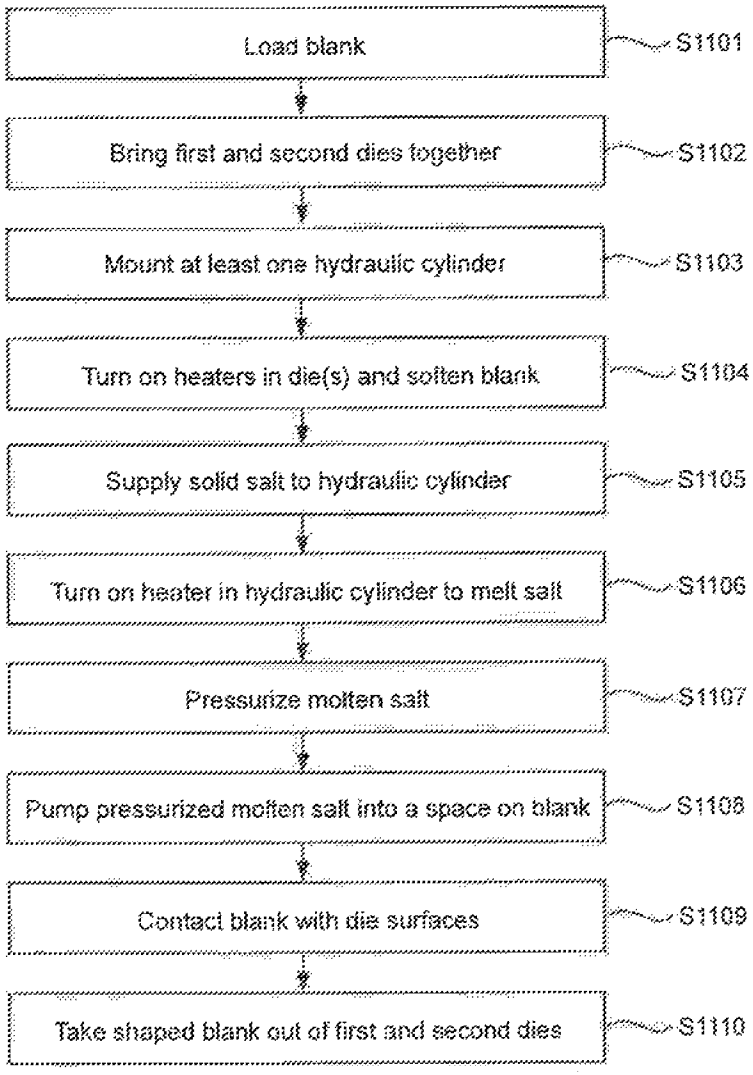
FIG. 11 is a flowchart indicating processes of hydro-forming a blank using a hydro-forming apparatus, consistent with another embodiment of the present disclosure.

References are now made to FIG. 11, a flowchart indicating an exemplary method of shaping a metal. FIG. 11 shows a step S1101 of loading a blank which may be a sheet blank, a tube blank, or a blank of any shape that is used to form another shape. The blank is made of metal or metal alloy. After loading the blank in step S1101, first and second dies 210 and 220 are brought together in a step S1102. Then, in a step S1103, at least one hydraulic cylinder is mounted to the assembly of the dies. In a step S1104, the heaters in the dies are turned on to soften the blank. After that, salt is supplied to the hydraulic cylinder in a step S1105. In a step S1106, the heater in the hydraulic cylinder is turned on, and the salt supplied to the hydraulic cylinder is melted. In a amp S1107, the molten salt is pressurized. The pressurized molten salt is injected by the pump through the hydraulic cylinder into a space in the blank in a step S1108. During a step S1109, the blank is forced into intimate contact with the dies. Then, in a step S1110, the shaped blank is taken out of the dies.

Figure 12:
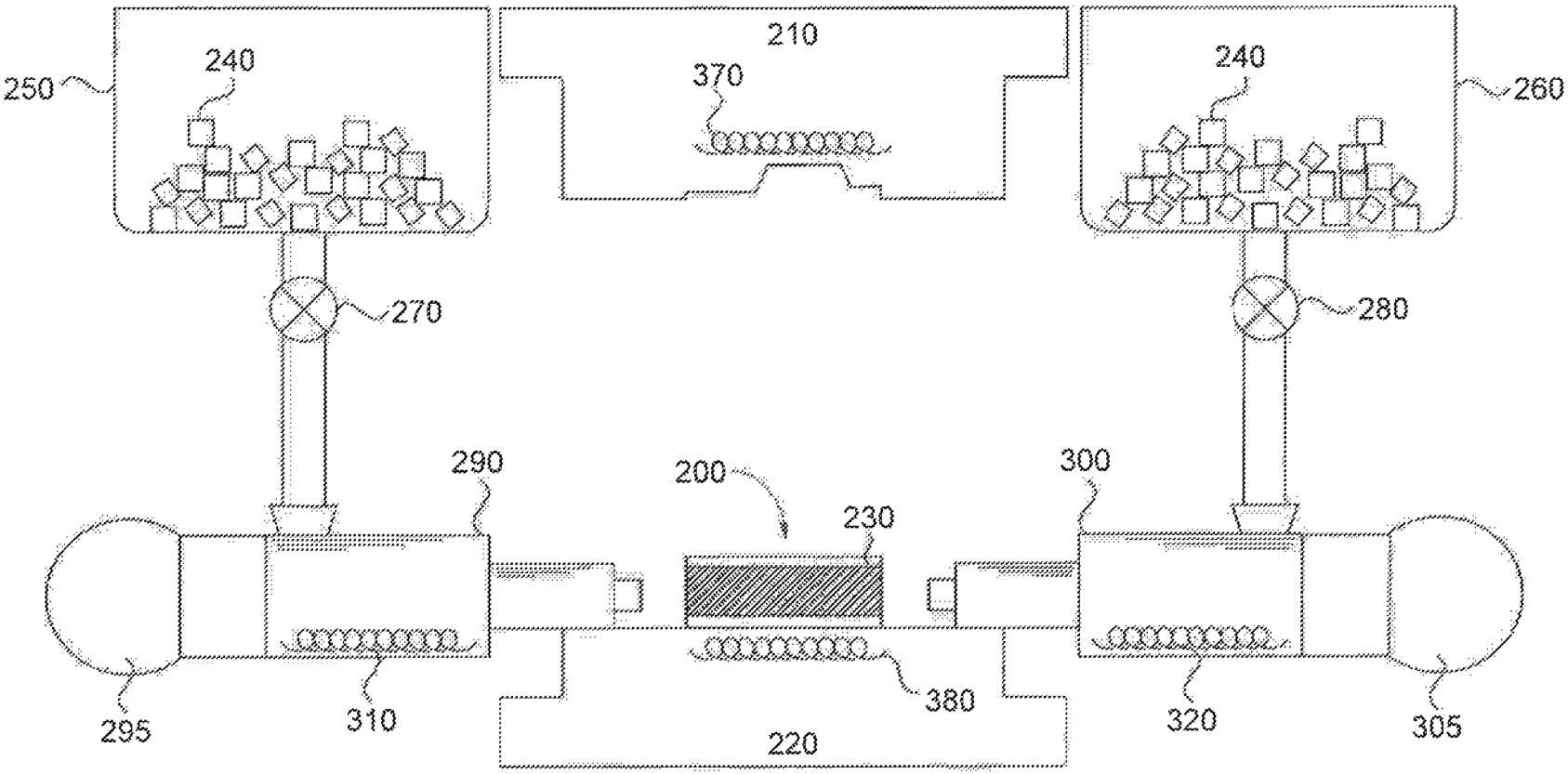
FIG. 12 is a cross-sectional diagram indicating a step S1101 of the flowchart of FIG. 1, consistent with an embodiment of the present disclosure.

FIG. 12 illustrates an exemplary hydroforming apparatus to Implement the method of FIG. 11. As shown in FIG. 12, the hydroforming apparatus includes a first die 220, a second die 210, salt containers 250 and 260 containing solid salts 240, valves 270 and 280, hydraulic cylinders 290 and 300, pumps 295 and 305, and heaters 310 and 320, in some embodiments of the present disclosure.

In this embodiment, first and second dies 220 and 210 include heaters 370 and 380, respectively, Heaters 370 and 380 may be any type of heater that provides thermal energy, for example, a resistive heating coil or cable, a furnace, a radiant heater such as air infrared heater, or a laser heater. Valves 270 and 280 control the passage of salt from salt containers 250 and 260 to hydraulic cylinders 290 and 300. Valve 270 or 280 may be manual valves such as ball valve, butterfly valve, globe valve, gate valve, diaphragm valves, or electromechanical valves such as solenoid valves and robotic valves.

Salt containers 250 and 260 are made of a material that Is not corroded by salt including stainless steel, ceramics, and glass. Salt containers 250 and 260 in FIG. 11 do not contain any heater and the solid salt crystals pass through a tube controlled by valves 270 and 280 to the interior of hydraulic cylinders 290 and 300.

Each of hydraulic cylinders 2:90 and 300 may include a heater 310 and 320, respectively, for heating the solid salt crystals in hydraulic cylinders 290 and 300 passed from salt containers 250 and 260. Each of hydraulic cylinders 290 and 300 includes a pump 295 and 305, respectively. The pumps function to pressurize the molten salt inside hydraulic cylinders 290 and 300, Due to force provided by pumps 295 and 305, the molten salt becomes pressurized, and hydraulic cylinders 290 and 300 inject the molten salt into a space in a blank 230 loaded onto first die 220 by a loading mechanism 200. Pumps 295 and 305 may be any appropriate type of pump, such as rotary lobe pumps, progressing cavity pumps, rotary gear pumps, piston pumps, diaphragm pumps, screw pumps, gear pumps, or vane pumps.

In some embodiments, first die 220 and second the 210 function to shape blank 230 by force exerted by dies 210 and 220 or fluid pressure from the hydraulic cylinders 290 and 300.

The process as shown in FIG. 12 corresponds to step S1101 in the exemplary flowchart of FIG. 11. As shown in FIG. 11 and FIG. 12, in step S1101, blank 230 is loaded onto the first die 220 by loading mechanism 200. The loading mechanism may be a robotic arm or a lever system. In FIG. 12, blank 230 is in the form of a tube. However, the blank is not limited to a tube, it can be in a form of a sheet or a blank with any shape that is used to form another shape.

Blank 230 is made of a metal or metal alloy having low formability. The metal is selected from the group consisting of steel, titanium, nickel, aluminum, magnesium, and alloys thereof.

Figure 13:
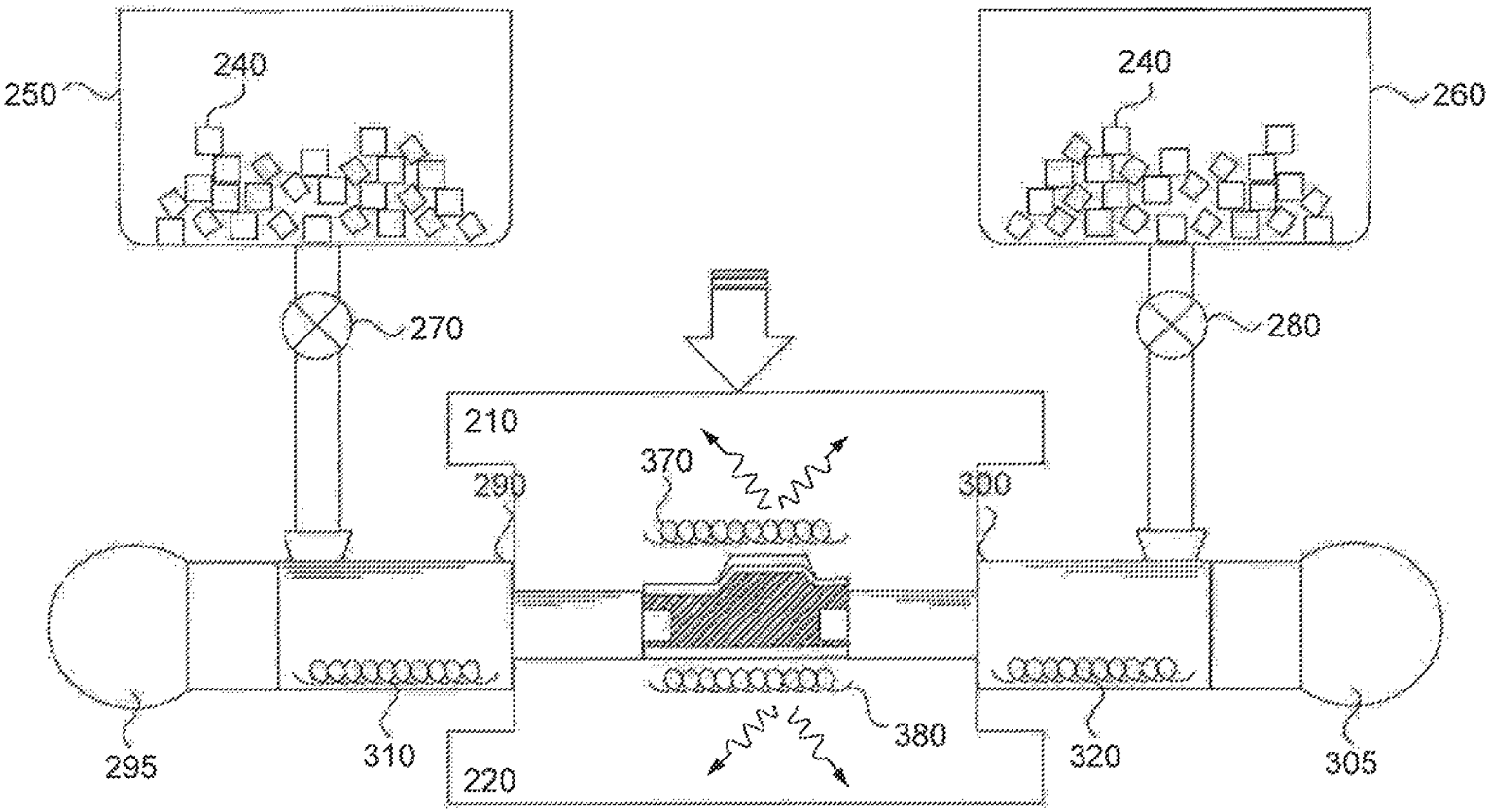
FIG. 13 is a cross-sectional diagram indicating processes S1102 and S1103 of the flowchart of FIG. 1, consistent with an embodiment of die present disclosure.
Figure 14:
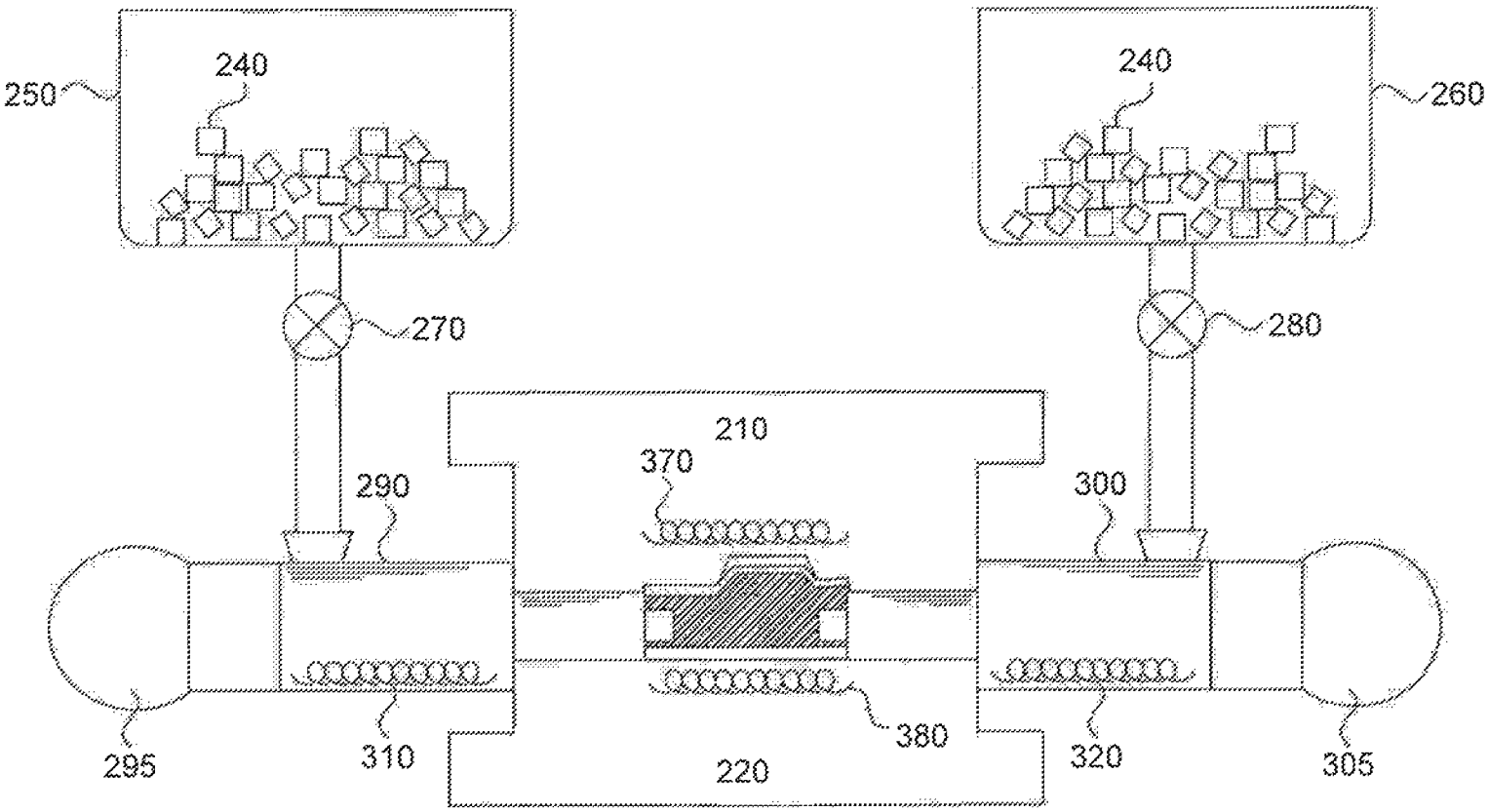
FIG. 14 is a cross-sectional diagram indicating a step S1104 of the flowchart of FIG. 1, consistent with an embodiment of the present disclosure.

Reference is now made to FIG. 13, a cross-sectional diagram or exemplary apparatus for shaping a metal, corresponding to the processes S1102, S1103, and S1104 of the flowchart of FIG. 1I, consistent with an embodiment of the present disclosure. As shown in FIGS. 11 and 13, after loading blank 230 in step S1101, first die 220 and second die 210 are brought together in step S1102. In FIG. 13, since first die 230 is stabilized on the floor, only second die 210 is brought downward (along the direction indicated by a block arrow in FIG. 13) toward first die 220, in some embodiments of the present disclosure. In other embodiments, both first die 220 and second die 210 are brought toward each other. Also, a force is applied to press the blank, in some embodiments of the present disclosure. In some embodiments, no force is applied to blank 230 and first and second dies 220 and 210 are positioned to a pre-set position for subsequent processes.

Also, as shown in FIG. 11 and FIG. 13, in step S1103, hydraulic cylinders 290 and 300 are mounted to both sides of the assembly of dies 210 and 220. In this embodiment, hydraulic, cylinder 290 includes heater 310, and hydraulic cylinder 300 includes heater 320. In another embodiment, only one of hydraulic cylinders 290 and 300 is mounted to either side of the assembly of dies 210 and 220.

In some embodiments of the present disclosure, after first and second dies 220 and 210 are brought together, at least one of heaters 370 and 380 are turned on to provide heat to blank 230 externally to soften blank 230, in step S1104. In some embodiments of the present disclosure, a temperature of heaters 370 and 38 is maintained within 100° C. of a deformation temperature of the metal of blank 230. In other embodiments, a temperature of heaters 370 and 380 is maintained within 50° C. of a deformation temperature of the metal of blank 230.

Heaters 310 and 320 may be any appropriate type of heater that provides thermal energy, for example, a resistive heating coil or cable, a furnace, a radiant heater such as an infrared heater, or a laser heater. Heaters 310 and 320 are connected to a controller that monitors, displays and controls temperatures of heaters 310 and 320, consistent with one or more exemplary embodiments of the present disclosure. Pumps 295 and 305 are connected to hydraulic cylinders 290 and 300 respectively, consistent with one or more exemplary embodiments of the present disclosure.

Figure 15:
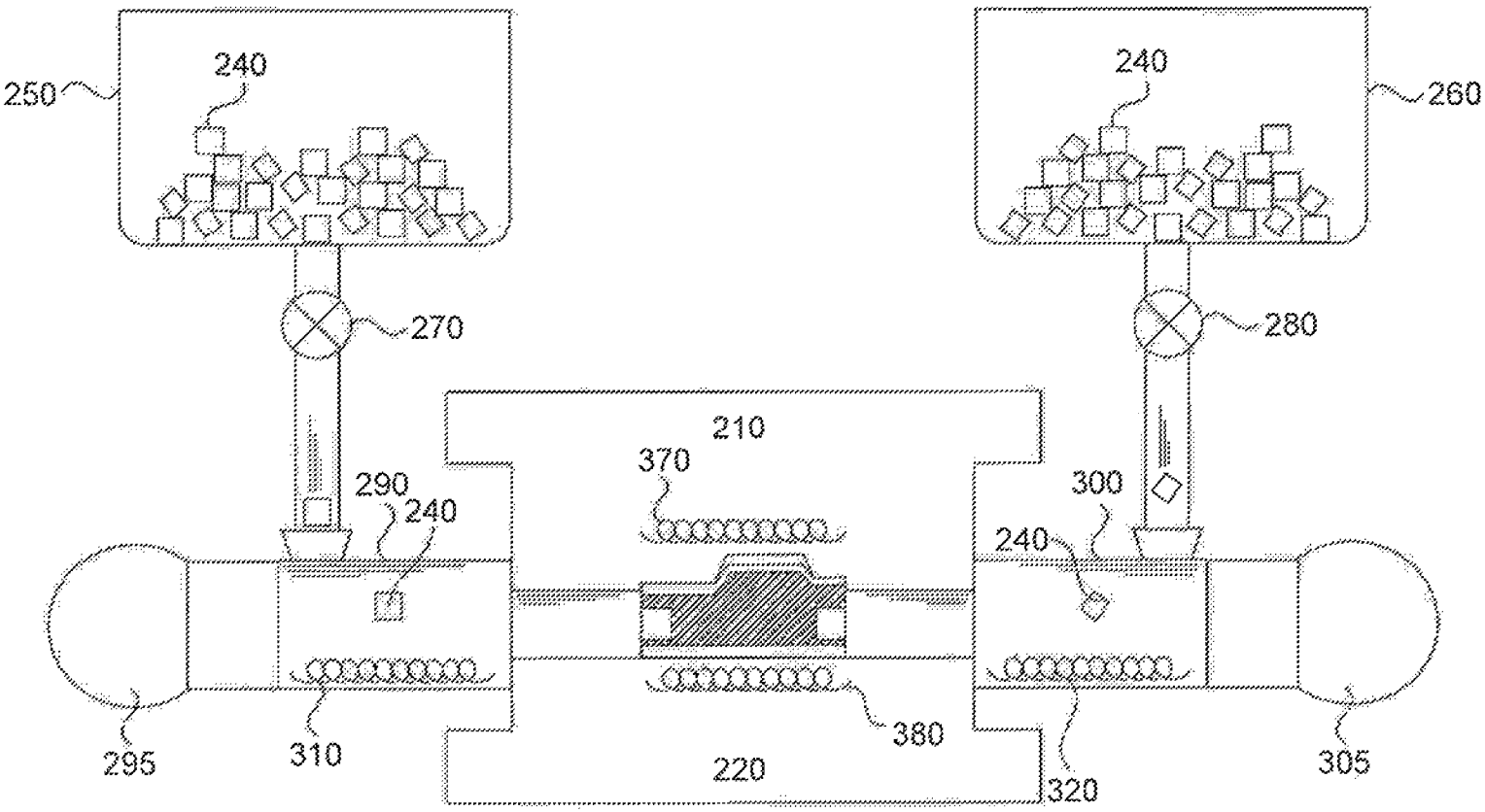
FIG. 15 is a cross-sectional diagram indicating a step S1105 of the flowchart of FIG. 1, consistent with an embodiment of the present disclosure.

Also, as shown in FIG. 11 and FIG. 15, salt is supplied to hydraulic cylinders 290 and 300 in step S1105. In this embodiment, the salt is contained in container 250 and 260 positioned the tops of hydraulic cylinders 290 and 300, and transferred to hydraulic cylinders 290 and 300 by opening valves 270 and 280 that connect containers 250 and 260 to hydraulic cylinders 290 and 300, respectively. In another embodiment, containers 250 and 260 are positioned on the same level as hydraulic cylinders 290 and 300, and the salt is transferred to the cylinders by any appropriate type of automatic transferring mechanism, for example, belt transfer.

Figure 16:
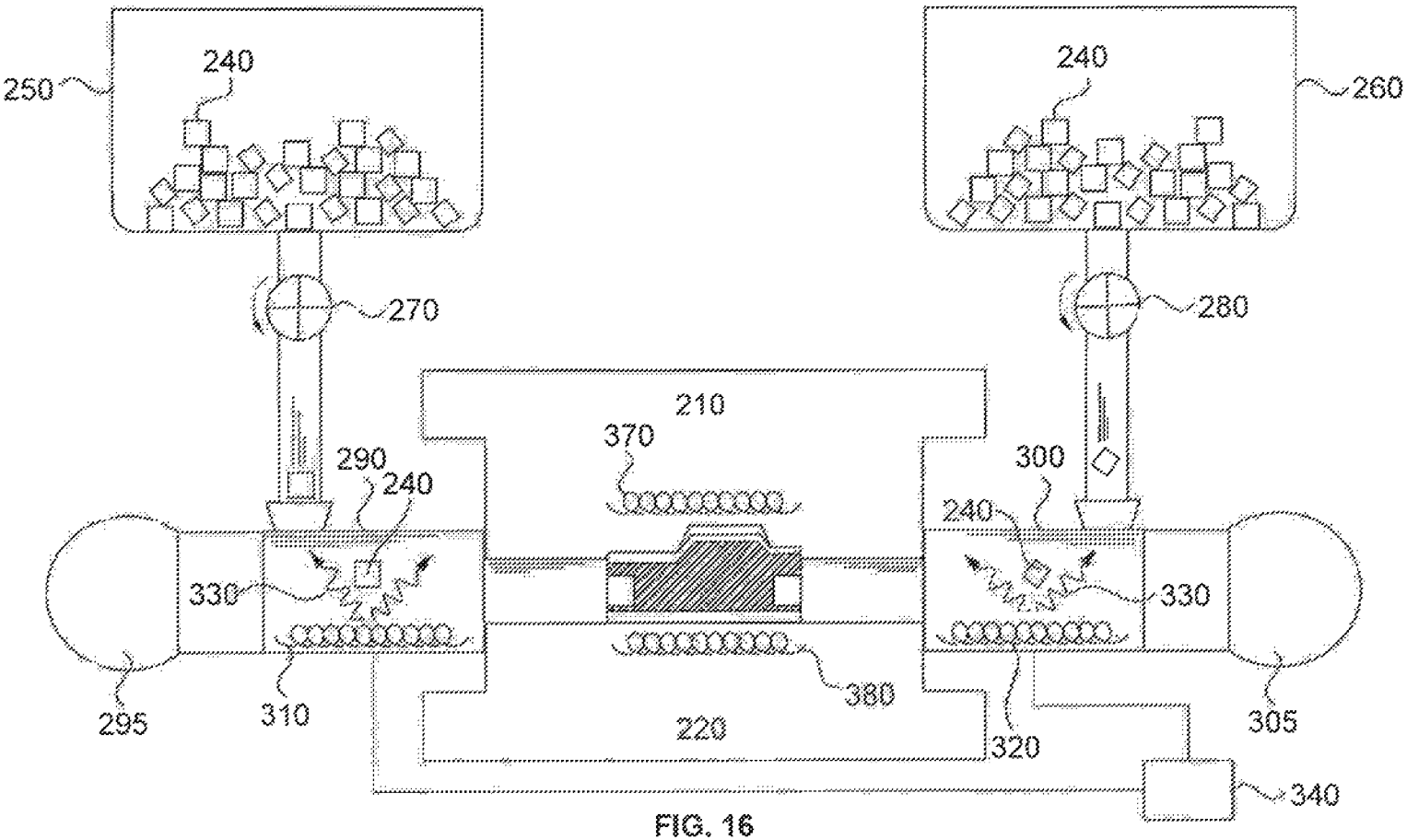
FIG. 16 is a cross-sectional diagram indicating a step S1106 of the flowchart of FIG. 1, consistent with an embodiment of (the present disclosure.

Reference is now made to FIG. 16, a cross-sectional diagram of exemplary apparatus for shaping a metal, corresponding to step S1106 of the flowchart of FIG. 11. As shown in FIG. 11 and FIG. 16, in step S1106, heaters 310 and 320 M hydraulic cylinders 290 and 300 are turned on, and the salt supplied to the hydraulic cylinders is melted. More specifically, in FIG. 16, controller 340 applies an electrical current to beaters 310 and 330 which heats up salt crystals 240 to form a molten salt.

The salt may be at least one of chloride salt, fluoride salt, cryolite salt, hydroxide salt, nitrate salt, and cyanide salt, consistent with some embodiments of the present disclosure. The temperature of the heaters is controlled based on a melting temperature of the salt so that the thermal energy provided by the heaters is sufficient to form a molten salt. A simple example of a salt is sodium chloride. In some embodiments, a temperature of the molten salt is maintained within 100° C. of a deformation temperature of the metal of blank 230. In other embodiments, a temperature of the molten salt is maintained within 50° C. of a deformation temperature of the metal of blank 230.

Figure 17:
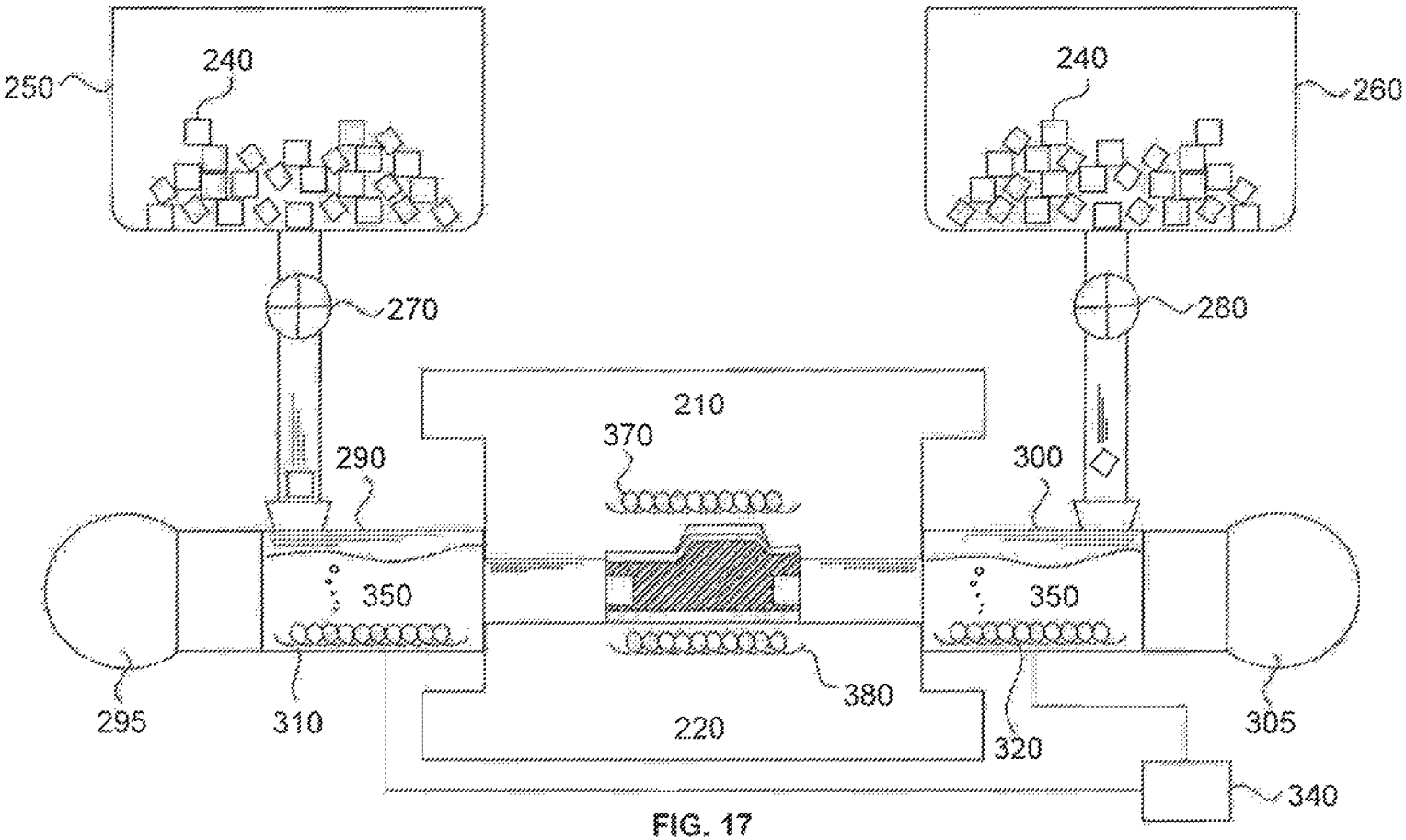
FIG. 17 is a cross-sectional diagram indicating a step S1107 of the flowchart of FIG. 1, consistent with an embodiment of the present disclosure.

Reference is now made to FIG. 17, a cross-sectional diagram of exemplary apparatus for shaping a metal, corresponding to step S1106 of the flowchart of FIG. 11, consistent with an embodiment of the present disclosure. As shown in FIG. 11 and FIG. 17, in step S1106, the molten salt inside hydraulic cylinders 290 and 300 is pressurized by pumps 295 and 305. At least one of hydraulic cylinders 290 and 303 thriller includes a pressure controller configured to monitor, display and control a pressure of the molten salt, consistent with some embodiments of the present disclosure.

Figure 18:
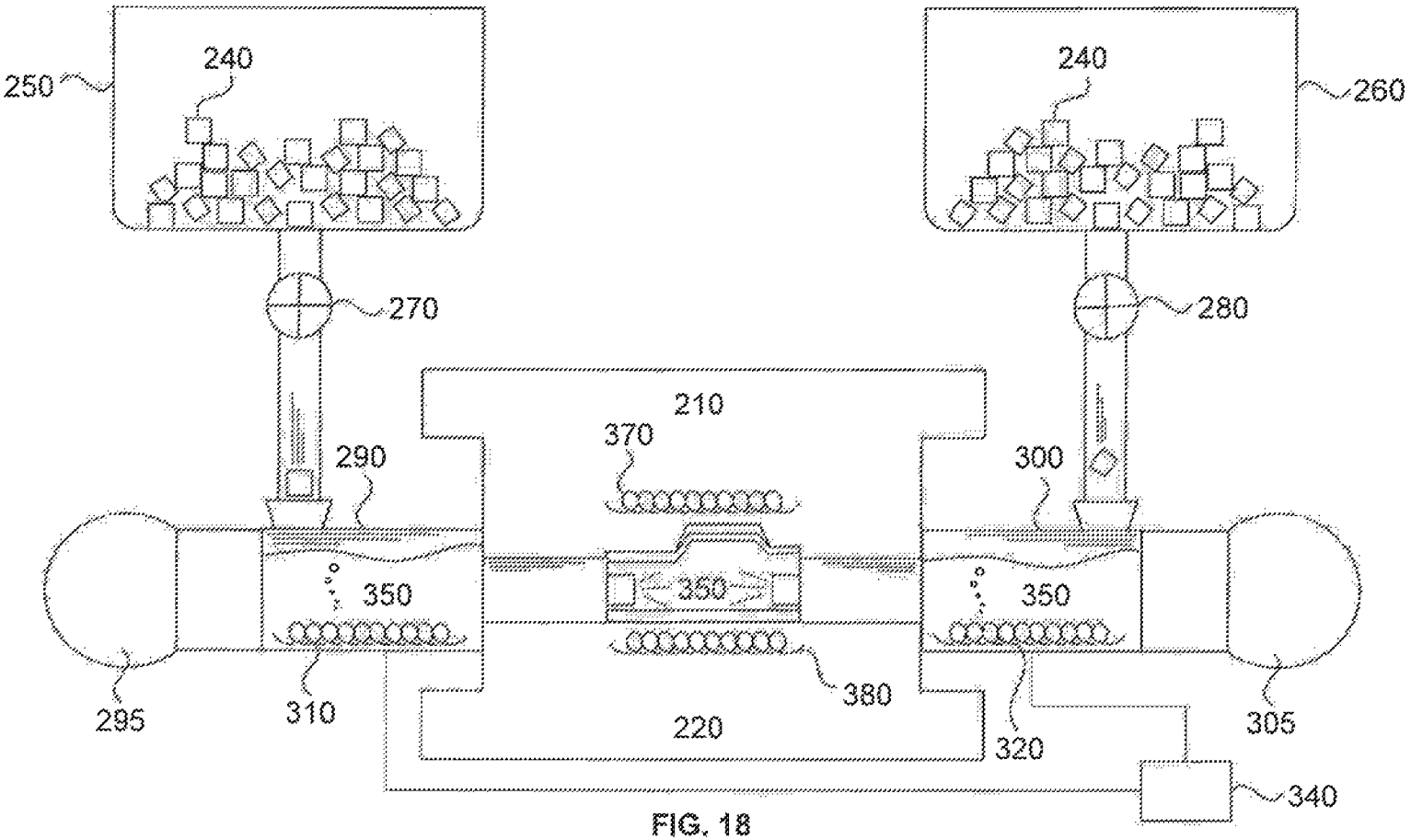
FIG. 18 is a cross-sectional diagram indicating a step S1108 of the flowchart of FIG. 1, consistent with an embodiment of the present disclosure.

Reference is now made to FIG. 18, a cross-sectional diagram of exemplary apparatus for shaping a metal, corresponding to a partial situation of a step S1107 of the flowchart of FIG. 11, consistent with an embodiment of the present disclosure. As shown in FIG. 11 and FIG. 18, in step S1107, pressurized molten salt 350 is injected by pumps 295 and 305 into a space in blank 230, sealed between dies 210 and 220. For a blank of a tube form, the space is the interior space of the tube blank. For a blank of a sheet form, the space is a space on the sheet blank. During this process, the heat provided internally by the molten salt softens blank 230. At the same time, heaters 370 and 380 provide heat to blank 230 externally, the interior and the exterior of blank 230 are heated simultaneously, which further promote temperature homogeneity of blank 230, and thereby prevents crack formation.

Figure 19:
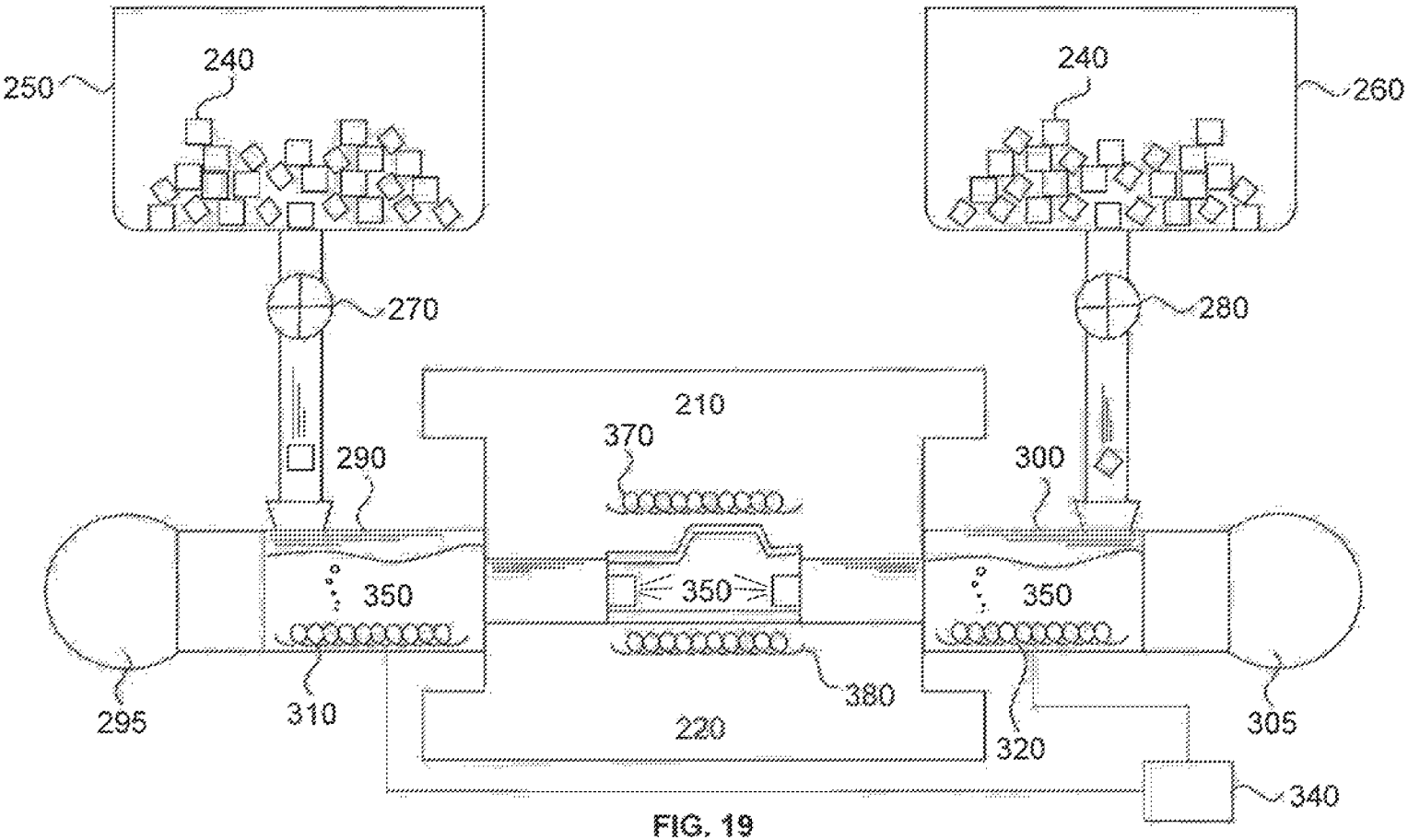
FIG. 19 is a cross-sectional diagram indicating a step S1109 of the flowchart of FIG. 1, consistent with an embodiment of the present disclosure.

Reference is now made to FIG. 19, a cross-sectional diagram of the apparatus for shaping a metal, corresponding to a partial situation of a step S1107 of the flowchart of FIG. 11, consistent with an embodiment of the present disclosure. As shown as FIG. 11 and FIG. 19, in step S1107, the injected pressurized molten salt presses blank 230 to contact dies 210 and 220. In this the shaping of blank 230 is carried cut.

Figure 20:
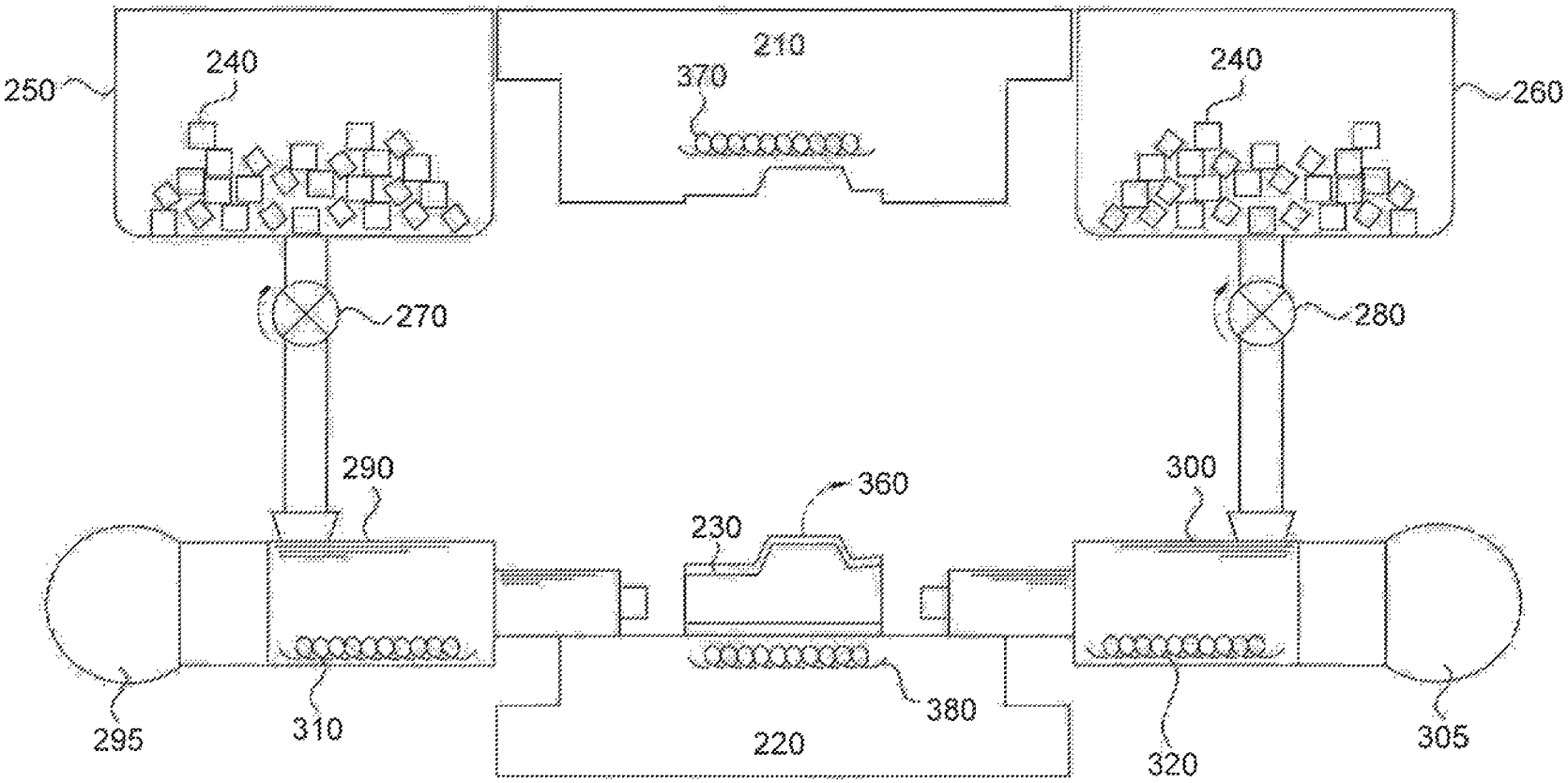
FIG. 20 is a cross-sectional diagram indicating a step S1110 of the flowchart of FIG. 1, consistent with an embodiment of the present disclosure.

Reference is now made to FIG. 20, a cross-sectional diagram of the apparatus for shaping a metal, corresponding to step S1108 of the flowchart of FIG. 11, consistent with en embodiment of the present disclosure. As shown in FIG. 11 and FIG. 20, in step S1108, dies 210 and 220 are moved away from each other and shaped blank 360 is taken from dies 210 and 220.

Third Embodiment

Figure 21:
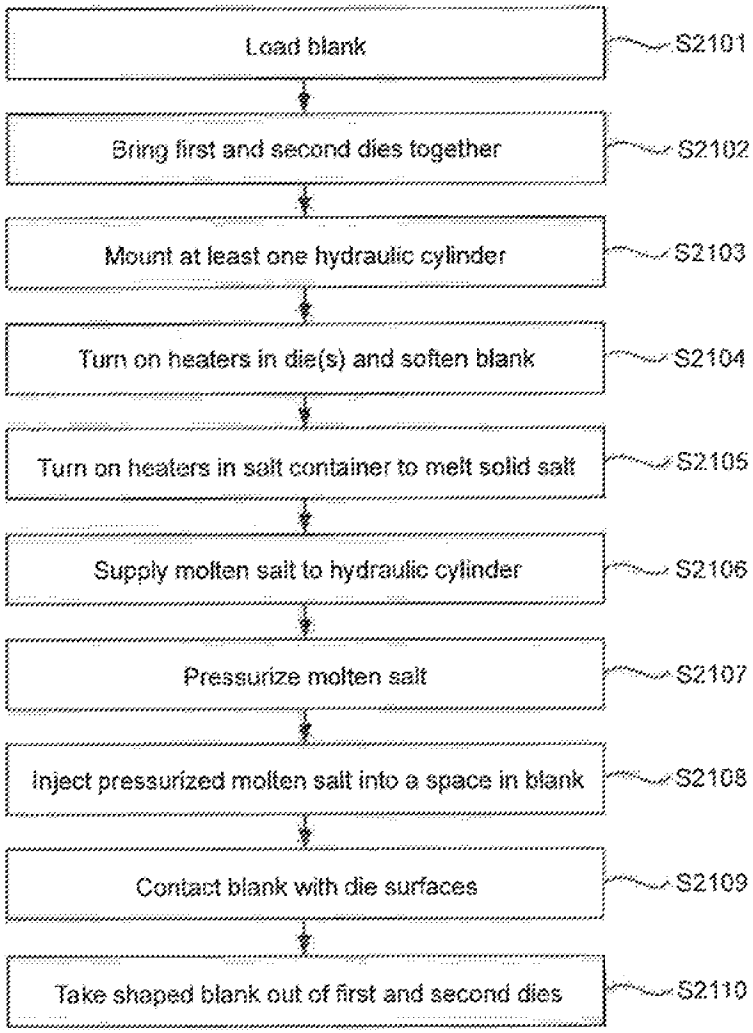
FIG. 21 is a flowchart indicating processes of hydro-forming a blank using a hydro-forming apparatus, consistent with another embodiment of die present disclosure.

Reference now made to FIG. 21, a flowchart indicating a method of shaping a metal, consistent with one or more exemplary embodiments of the present disclosure. FIG. 21 shows a step S2101 of loading a blank which is a sheet blank or a tube blank or a blank of any shape that is used to form another shape. The blank is made of metal or metal alloy. After loading the blank in step S2101, first and second dies are brought together in a step S2102. Then, in a step S2103, at least one hydraulic cylinder is mounted to the assembly of the dies. In a step S2104, the heaters in the dies are turned on to soften the blank. In a step S2105, the heater in the salt container is turned on, and the salt in the salt container is melted. After that, molten salt is supplied to the hydraulic cylinder in a step S2106. In a step S2107, the molten salt is pressurized. The pressurized molten salt is injected by the pump through the hydraulic cylinder into a space in blank in a step S2108. During a step S2109, the blank completely contacts the dies. Then, in a step S2110, the shaped blank is taken out of the dies.

Figure 22:
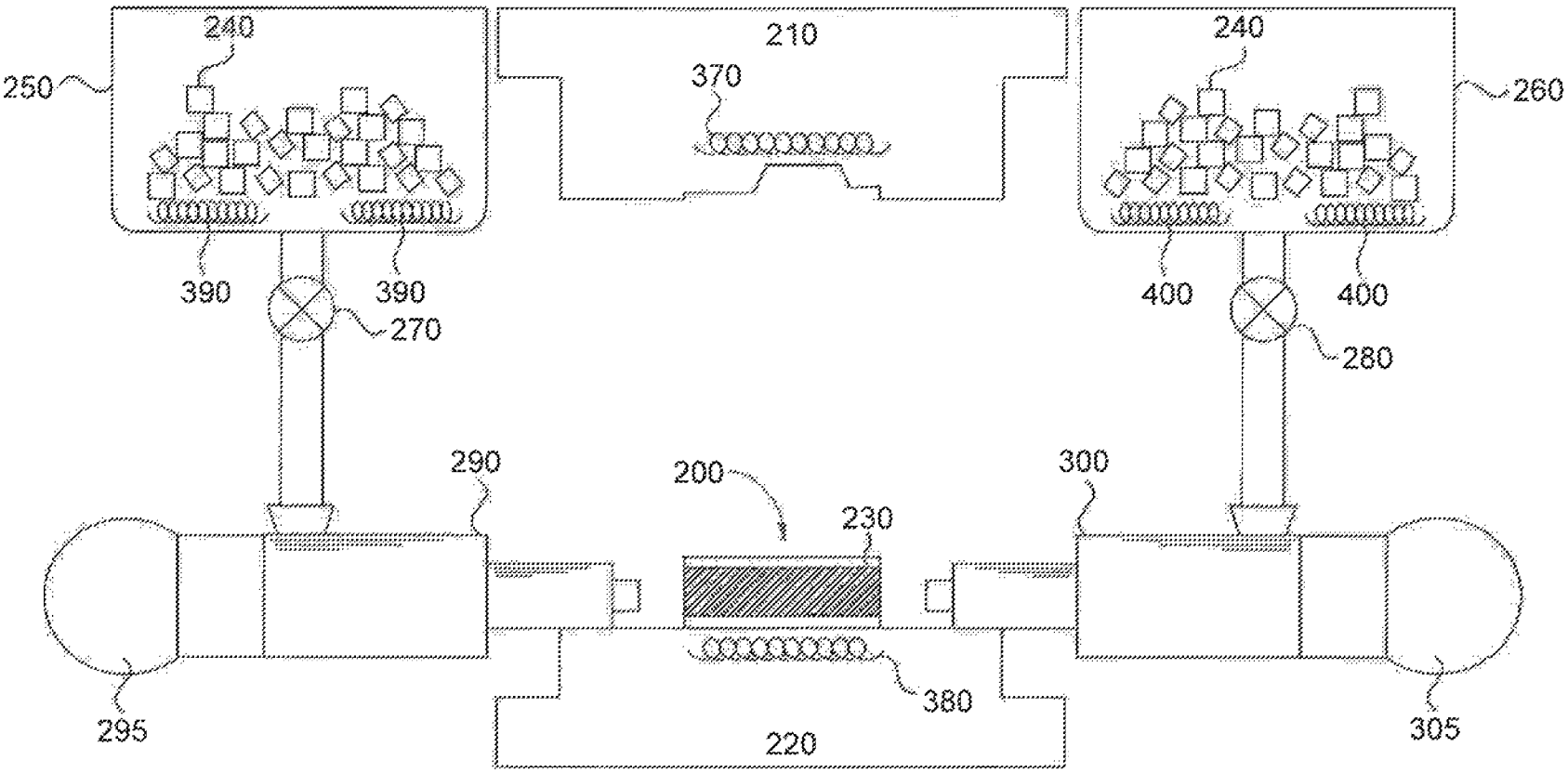
FIG. 22 is a cross-sectional diagram indicating a step S2101 of the flowchart of FIG. 1, consistent with an embodiment of the present disclosure.

FIG. 22 illustrates an exemplary hydroforming apparatus to implement the method of FIG. 21. As shown in FIG. 22, the hydroforming apparatus includes first die 220, second die 210, salt containers 250 and 250 containing solid salts 240, valves 270 and 280, hydraulic cylinders 290 and 300, pumps 295 and 305, and heaters 310 and 320.

In this embodiment, first and second dies 210 and 220 include heaters 370 and 380, respectively. Heaters 370 and 380 are any type of heaters that provide thermal energy, for example, but not limited to a resistive heating coil or cable, a furnace, a radiant heater such as an infrared heater, and a laser heater, consistent with one or more, exemplary embodiments of the present disclosure. Valves 270 and 280 control the passage of salt from salt containers 250 and 260 to hydraulic cylinders 290 and 300, in some embodiments of the present disclosure. Valve 270 or 280 is one of manual valves such as ball valve, butterfly valve, globe valve, gate valve, diaphragm valves, electromechanical valves such as solenoid valve, and robotic valve, in some embodiments of the present disclosure.

Salt containers 250 and 260 are made of a material that is not corroded by salt including stainless steel, ceramics, and glasses, in some embodiments of the present disclosure. Salt containers 250 and 260 in FIG. 22 include heaters 390 and 400 that provide heat to the solid salt crystals to form molten salt (not shown). The molten salt passes through a tube guarded by valves 270 and 280 to the interior of hydraulic cylinders 709 and 300, respectively, in some embodiments of the present disclosure.

In this embodiment, hydraulic cylinders 290 and 300 do not include any heaters. Each of hydraulic cylinders 290 and 300 includes a pump 295 and 305, respectively. The pumps function to pressurize the molten salt inside hydraulic cylinders 290 and 300. Due to an applied pressure provided by pumps 295 and 305 and the seal formed around blank 230, the molten salt becomes pressurized and hydraulic cylinders 290 and 300 inject the molten salt into a space in blank 230 loaded onto first die 220 by loading mechanism 200. In some embodiments of the present disclosure, pumps 295 and 305 are one of rotary lobe pump, progressing cavity pump, rotary gear pump, piston pump, diaphragm pump, screw pump, gear pump, and Vane pump.

In some embodiments, first die 220 and second die 210 function to shape blank 230 by pressing dies 210 and 220 or fluid pressure from hydraulic cylinders 290 and 300.

The process as shown in FIG. 22 corresponds step S2101 in the flowchart of FIG. 21, consistent with an embodiment of the present disclosure. As shown in FIG. 21 and FIG. 22, step S2101, blank 230 is loaded onto first die 220 by a leading mechanism 200. The loading mechanism is a robotic arm or a lever system, in some embodiments of the present disclosure. In FIG. 22, blank 230 is in the form of a tube. However, the blank is not limited to a tube, it can be in a form of a sheet or a blank with any shape that is used to form another shape.

Blank 230 is made of a metal. The metal is any metal or metal alloy having low formability, consistent with some embodiments of the present disclosure. The metal is selected from the group consisting of steel, titanium, nickel, aluminum, magnesium, and alloys thereof, consistent with some embodiments of the present disclosure.

Figure 23:
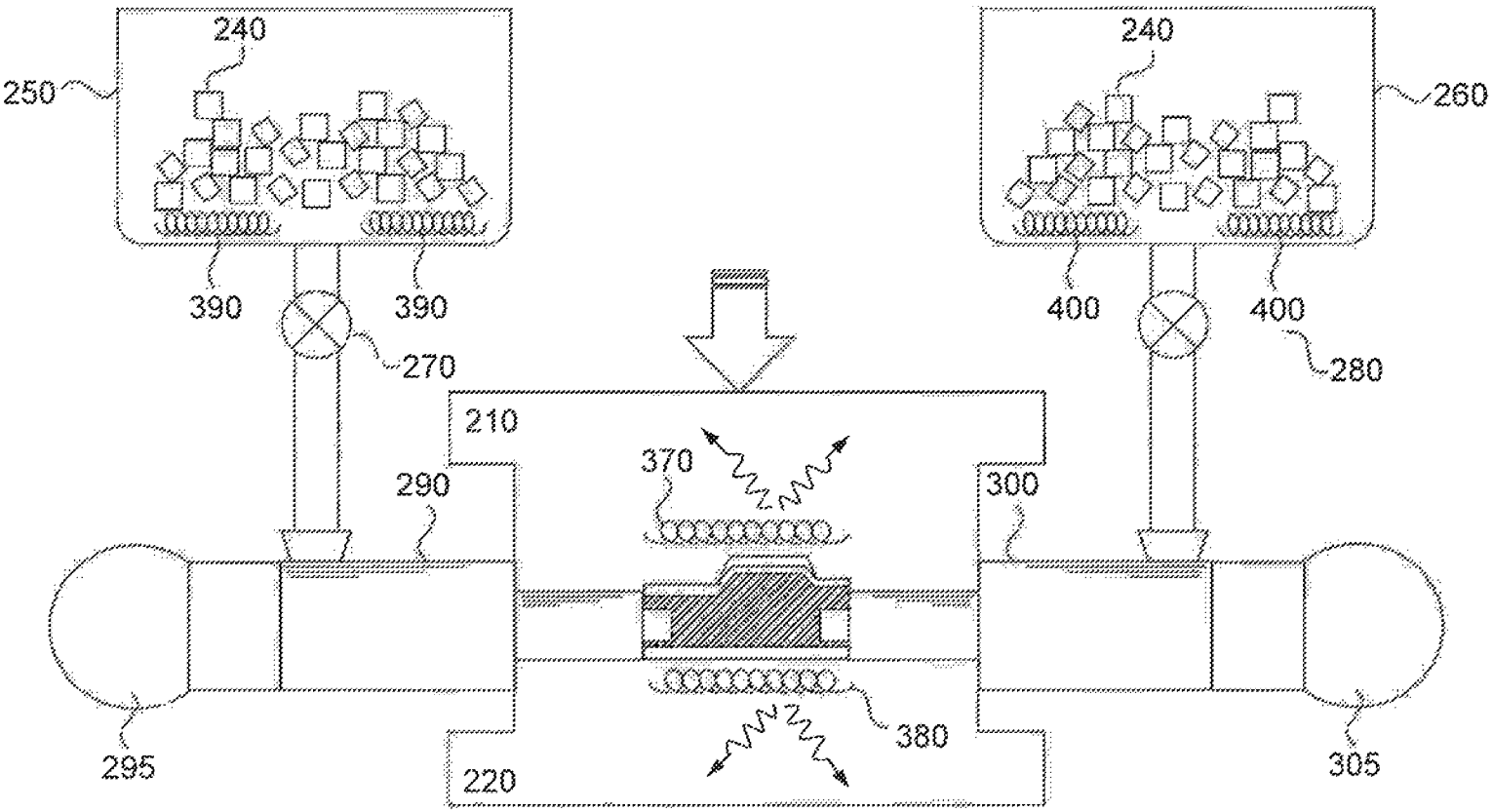
FIG. 23 is a cross-sectional diagram indicating steps S2102 and S2103 of lire flowchart of FIG. 1, consistent with an embodiment of the present disclosure.

Reference is now made to FIG. 23, a cross-sectional diagram of the apparatus for shaping a metal, corresponding to step S2102 of the flowchart of FIG. 21, consistent with an embodiment of the present disclosure. As shown in FIG. 21 and FIG. 23, after loading blank 230 in step S2101, first die 220 and second die 210 are brought together in step S2102 to seal blank 230 therebetween. In FIG. 23, since first die 220 is stabilized on the floor, only second die 210 is brought downward toward (along the direction indicated by a block arrow in FIG. 23) first die 220, in some embodiments of the present disclosure. In other embodiments, both first die 220 and second die 210 are brought toward each other. Also, a force is applied to press blank 230, in some embodiments of the present disclosure. In some embodiments, no force is applied to blank 230 and first and second dies 220 and 210 are positioned to a pre-set position for subsequent processes.

In some embodiments of the present disclosure, after first and second dies 220 and 210 are brought together, at least of heaters 370 and 380 is turned on to provide heat to blank 230 externally to soften blank 230. In some embodiments of the present disclosure, a temperature of heaters 370 and 380 is maintained within 100° C. of a deformation temperature of the metal of blank 230. In other embodiments, a temperature of beaten 370 and 380 is maintained within 50° C. of a deformation temperature of the metal of blank 230.

Figure 24:
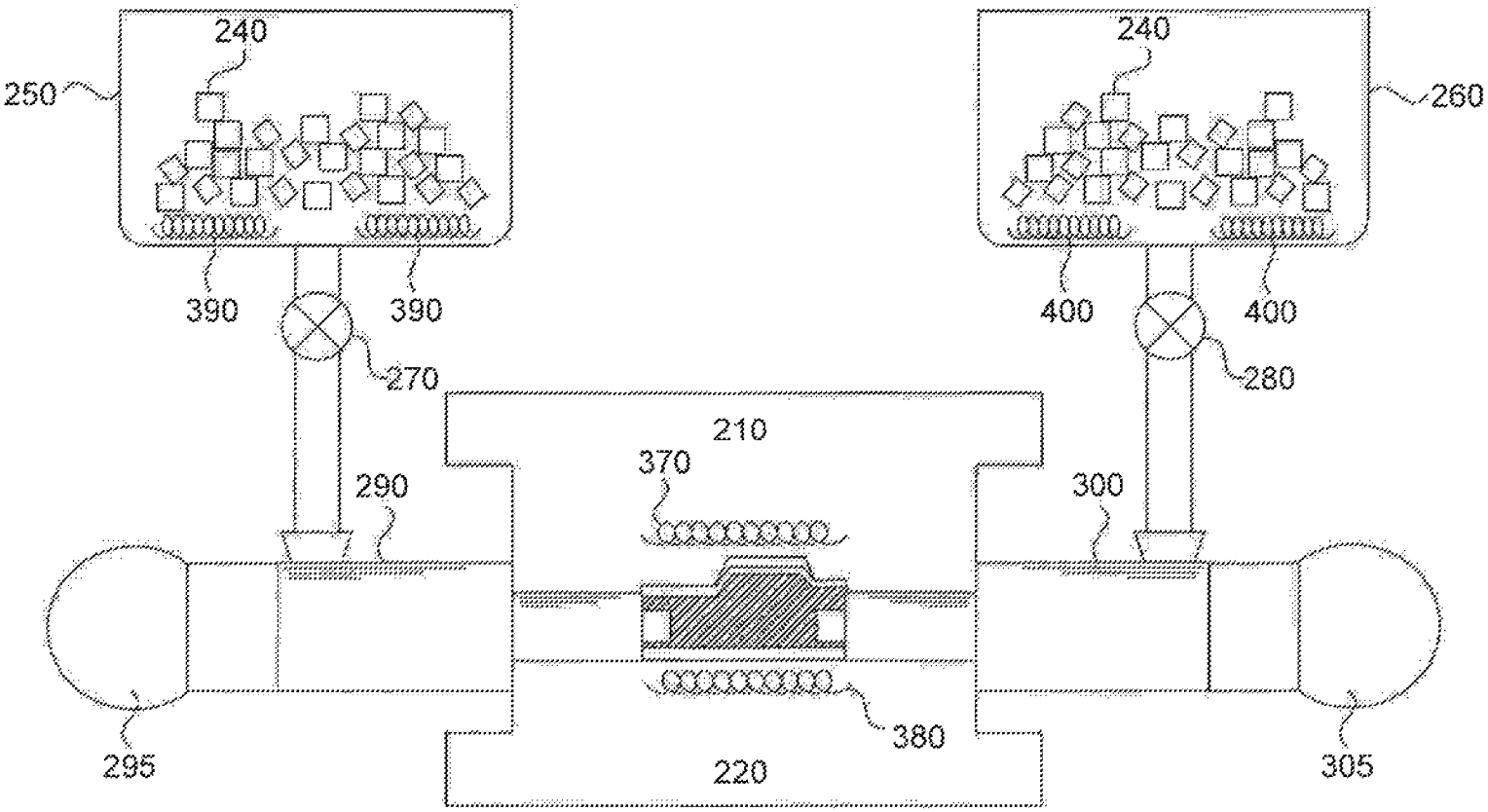
FIG. 24 is a cross-sectional diagram indicating a step S2104 of the flowchart of FIG. 1, consistent with an embodiment of the present disclosure.

Reference is now made to FIG. 24, a cross-sectional diagram of the apparatus for shaping a metal, corresponding to step S2103 of the flowchart of FIG. 21, consistent with art embodiment of the present disclosure. As shown in FIG. 2.1 and FIG. 24, in step S2103, two hydraulic cylinders 290 and 300 are mounted to both sides of the assembly of dies 210 and 220. In another embodiment, only one of hydraulic cylinders 290 and 300 is mounted to either side of the assembly of dies 210 and 220.

Heaters 390 and 400 may be any appropriate type of heater that provides thermal energy, for example, but not limited to a resistive heating coil or cable, furnace, radiant heater such as an infrared beater, and a laser heater, consistent with one or more exemplary embodiments of the present disclosure. Heaters 390 and 400 are connected to a controller that monitors, displays and controls temperatures of heaters 390 and 400, consistent with one or more exemplary embodiments of the present disclosure. Pumps 295 and 305 are connected to hydraulic cylinders 290 and 300 respectively, consistent with one or more exemplary embodiments of the present disclosure.

Figure 25:
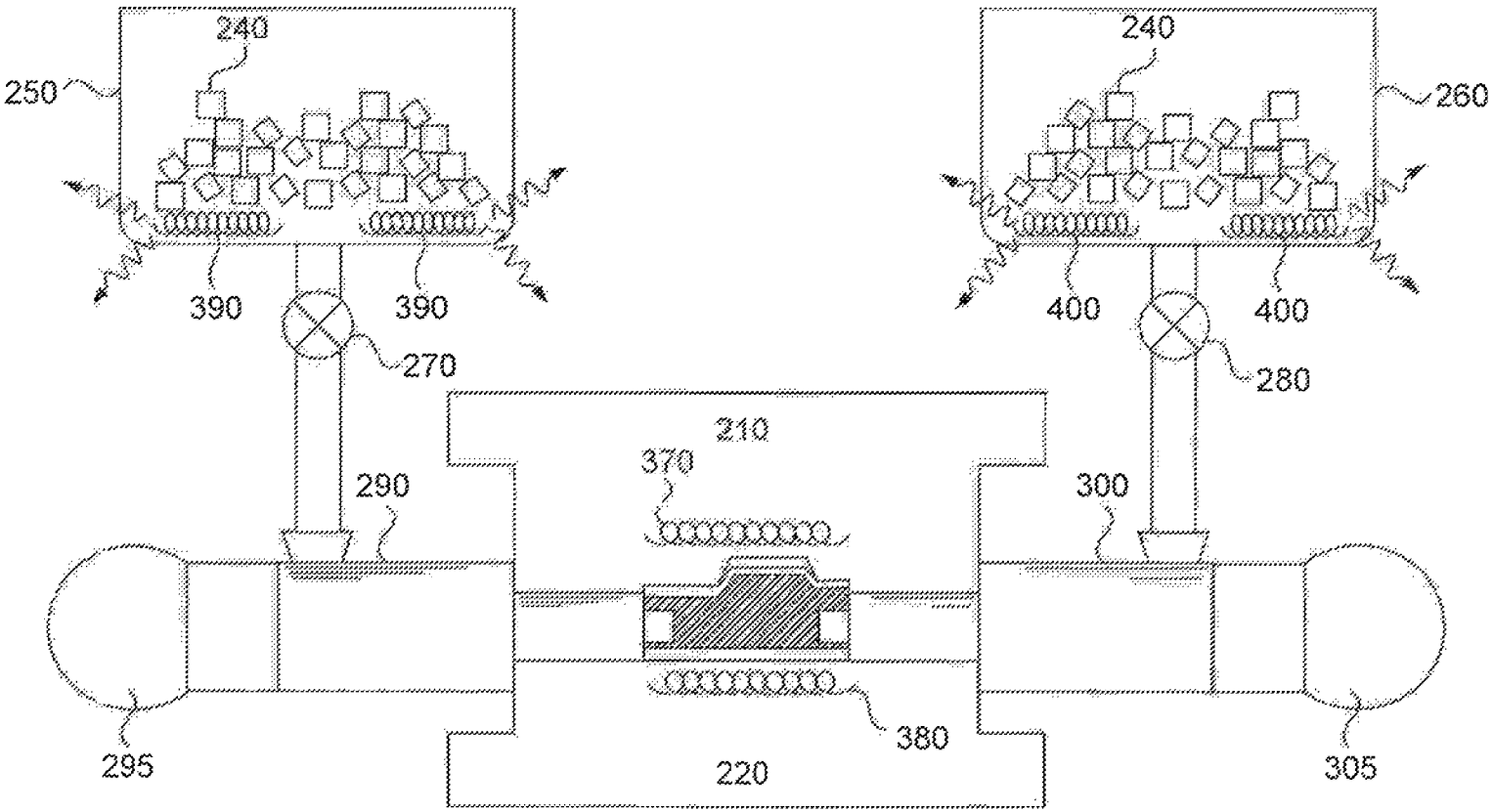
FIG. 25 is a cross-sectional diagram indicating a step S2105 of the flowchart of FIG. 1, consistent with an embodiment of the present disclosure.

Reference is now made to FIG. 25, a cress-sectional diagram of exemplary apparatus for shaping a metal, corresponding to the processes S2104 and S2105 of the flowchart of FIG. 21, consistent with an embodiment of the present disclosure. As shown in FIG. 21 and FIG. 25, in step S2104, beaters 370 and 380 are turned on to soften blank 230, and in step S2105, heaters 390 and 400 are turned on to melt salt 240 inside containers 250 and 260.

Figure 26:
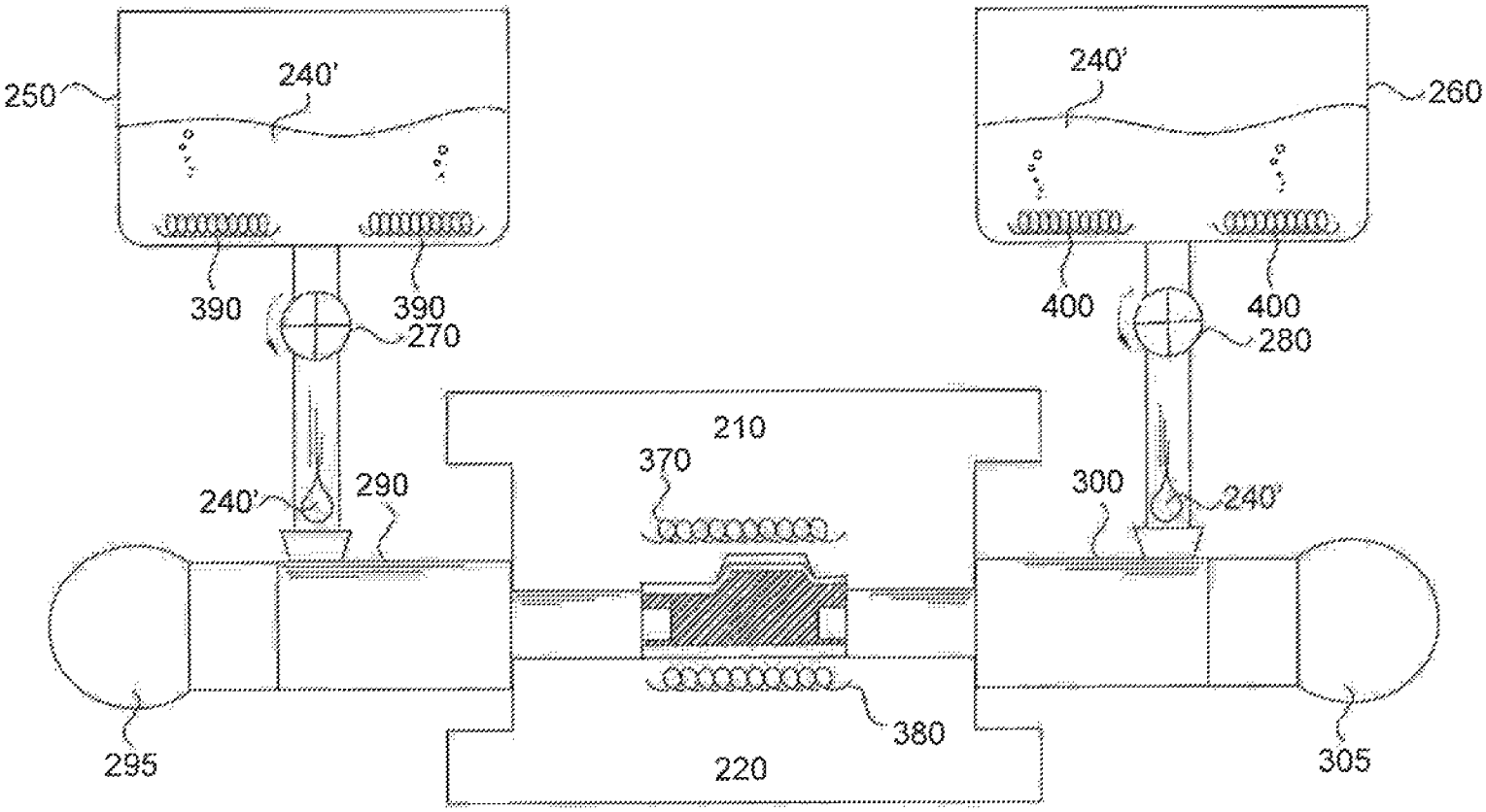
FIG. 26 is a cross-sectional diagram indicating a step S2106 of the flowchart of FIG. 1, consistent with an embodiment of the present disclosure.

Reference is now made to FIG. 26, a cross-sectional diagram of the apparatus for shaping a metal, corresponding to step S2106 of the flowchart of FIG. 21, consistent with an embodiment of the present disclosure. As shown in FIG. 21 and FIG. 26, in step S2106, molten salt 240' is supplied to hydraulic cylinders 290 and 300. In this embodiment, salt containers 250 and 260 are positioned on the tops of hydraulic cylinders 290 and 300, and molten salt 240' transferred to hydraulic cylinders 290 and 300 by opening valves 270 and 280 that connect containers 250 and 260 to hydraulic cylinders 290 and 300, respectively.

The salt is at least one of chloride salt, fluoride salt, cryolite salt, hydroxide salt, nitrate salt, and cyanide salt, consistent with some embodiments of the present disclosure. The temperature of the heaters is controlled based on a melting temperature of the salt so that the thermal energy provided by the heaters are sufficient to form a molten salt. A simple example of a salt is sodium chloride ("table salt") which has a melting temperature of 801° C. The molten salt is a stable liquid and flows much like water does. The significant difference between the molten salt and water is that the much higher temperatures attainable in the molten salt state provides heat to blank 230 to soften the blank, which ensures successful forming process without cracks formation.

In some embodiments, a temperature of the molten salt is maintained within 100° C. of a deformation temperature of the metal of blank 230. In other embodiments, a temperature of the molten salt is maintained within 50° C. of a deformation temperature of the metal of blank 230.

Figure 27:
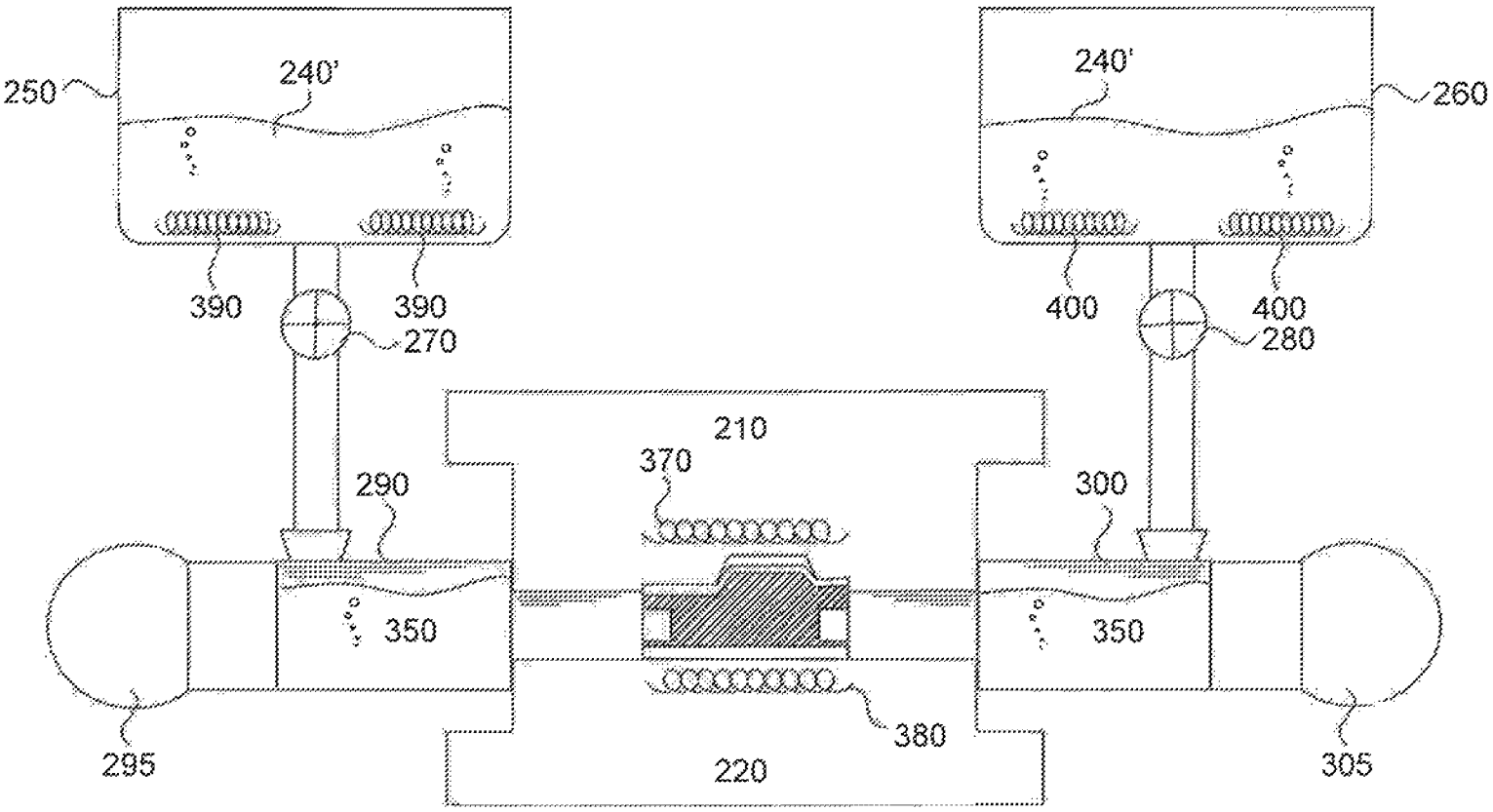
FIG. 27 is a cross-sectional diagram indicating a step S2107 of the flowchart of FIG. 1, consistent with an embodiment of the present disclosure.

Reference is now made to FIG. 27, a cross-sectional diagram of the apparatus for shaping a metal, corresponding to step S2107 of the flowchart of FIG. 21, consistent with an embodiment of the present disclosure. As shown in FIG. 21 and FIG. 27, in step S2107, the molten salt inside hydraulic cylinders 290 and 300 is pressurized by pumps 295 and 305. At least one of hydraulic cylinders 290 and 300 farther includes a pressure controller configured to monitor, display and control a pressure of the molten salt, consistent with some embodiments of the present disclosure.

Figure 28:
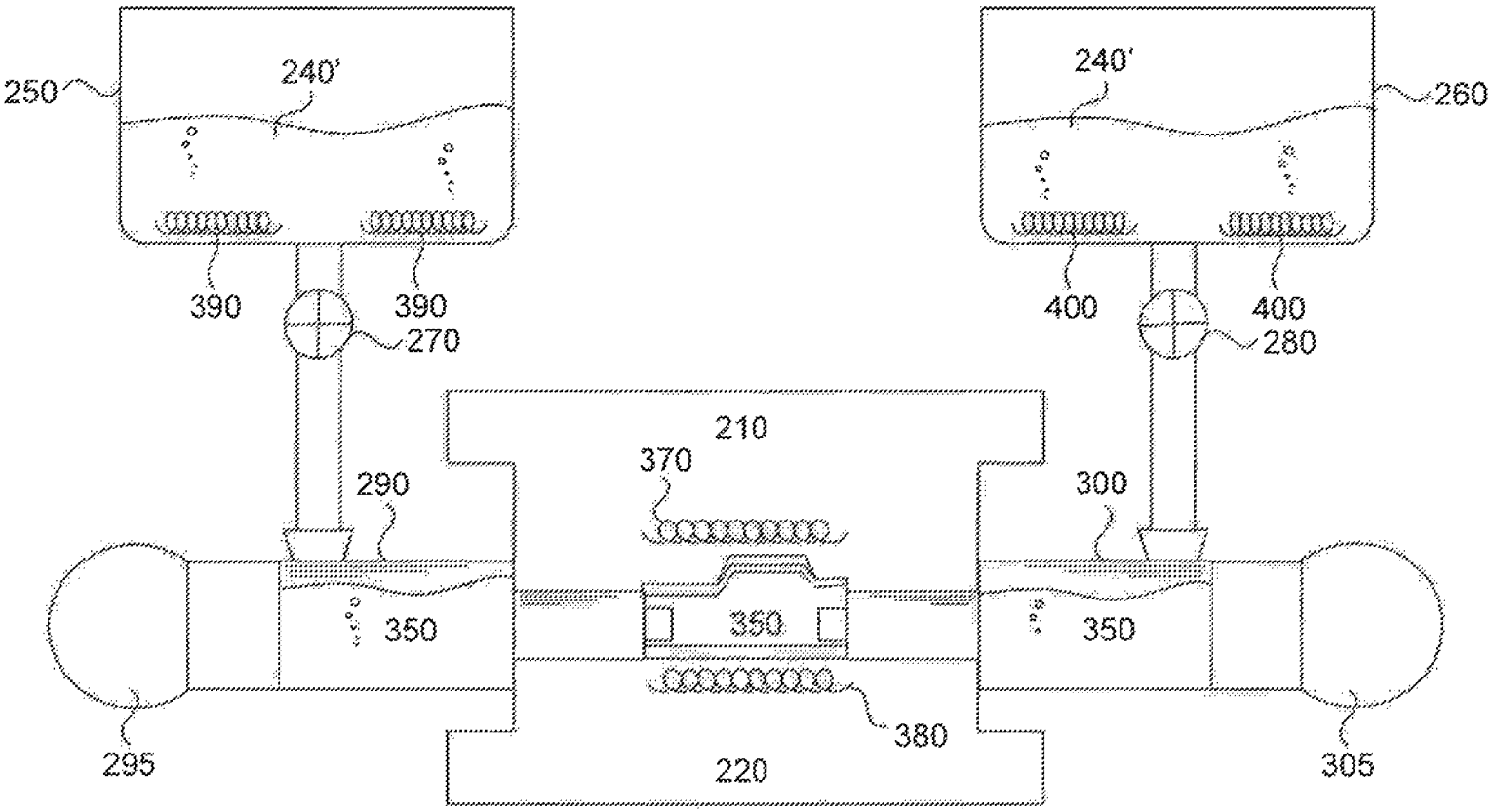
FIG. 28 is a cross-sectional diagram indicating a step S2108 of the flowchart of FIG. 1, consistent with an embodiment of the present disclosure.

Reference is now made to FIG. 28, a cross-sectional diagram of die apparatus for shaping a metal, corresponding to a partial situation of a step S2108 of the flowchart of FIG. 21, consistent with an embodiment of the present disclosure. As shown in FIG. 21 and FIG. 28, in step S2108, a pressurized molten salt 350 is injected by pumps 295 and 305 into a space in blank 230. For a blank of a tube form, the space is the interior space of the tube blank. For a blank of a sheet form, the space is a space on the sheet blank. During this process, the heat provided internally by the molten salt softens blank 230. At the same time, the heaters 370 and 380 provide heat to blank 230 externally, the interior and the exterior of blank 230 are heated simultaneously, which promote temperature homogeneity of blank 230, and thereby prevents crack formation.

Figure 29:
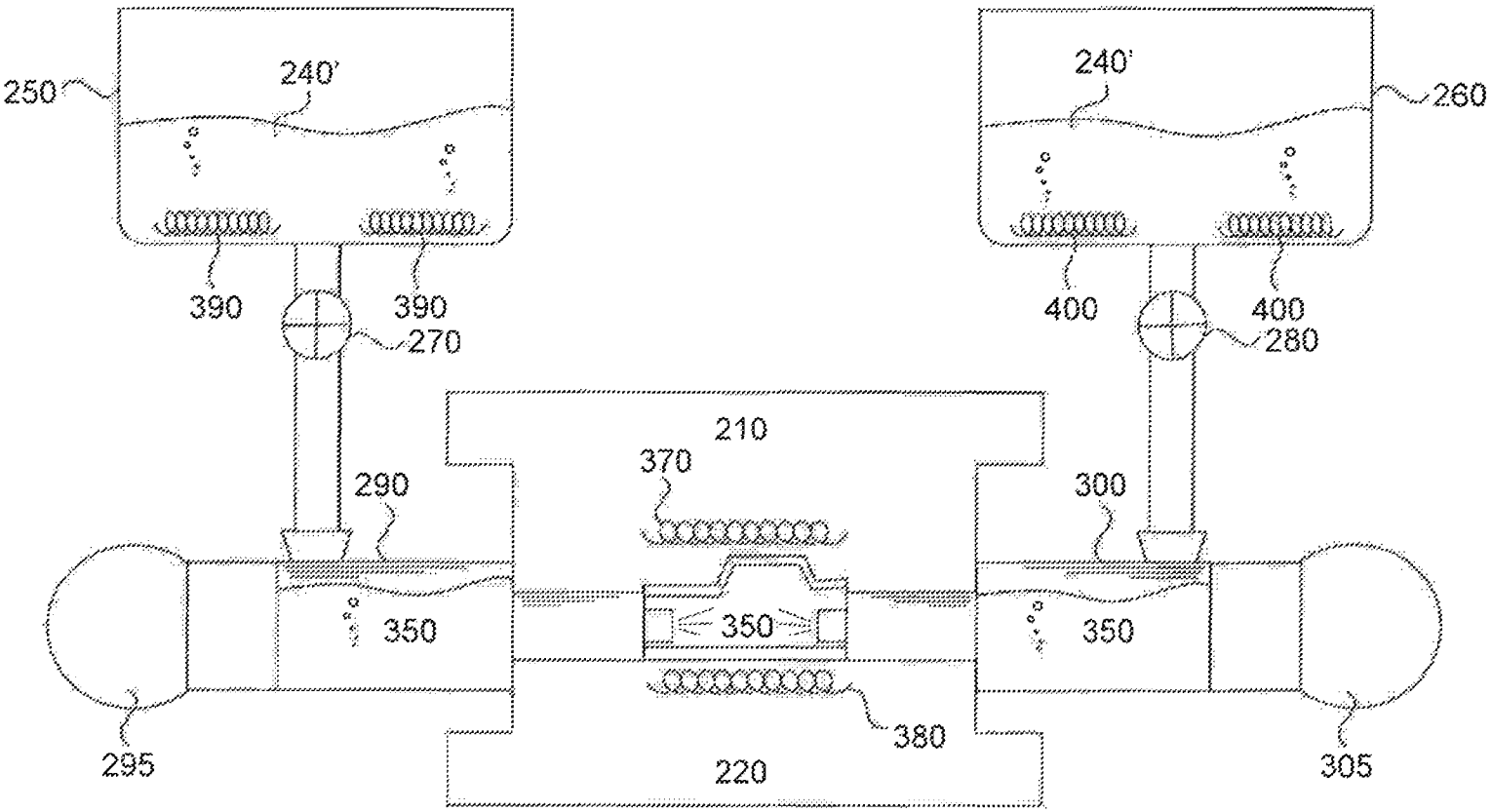
FIG. 29 is a cross-sectional diagram indicating a step S2109 of the flowchart of FIG. 1, consistent with an embodiment of the present disclosure.

Reference is now made to FIG. 29, a cross-sectional diagram of the apparatus for shaping a metal, corresponding to a partial situation of a step S2109 of the flowchart of FIG. 21, consistent with an embodiment of the present disclosure. As shown in FIG. 21 and FIG. 29, in step S2109, due to the seal formed around blank 230, pressure is maintained and the injected pressurized molten salt presses the blink 230 to contact dies 210 and 220. In this way, the shaping of blank 230 is carried out.

Figure 30:
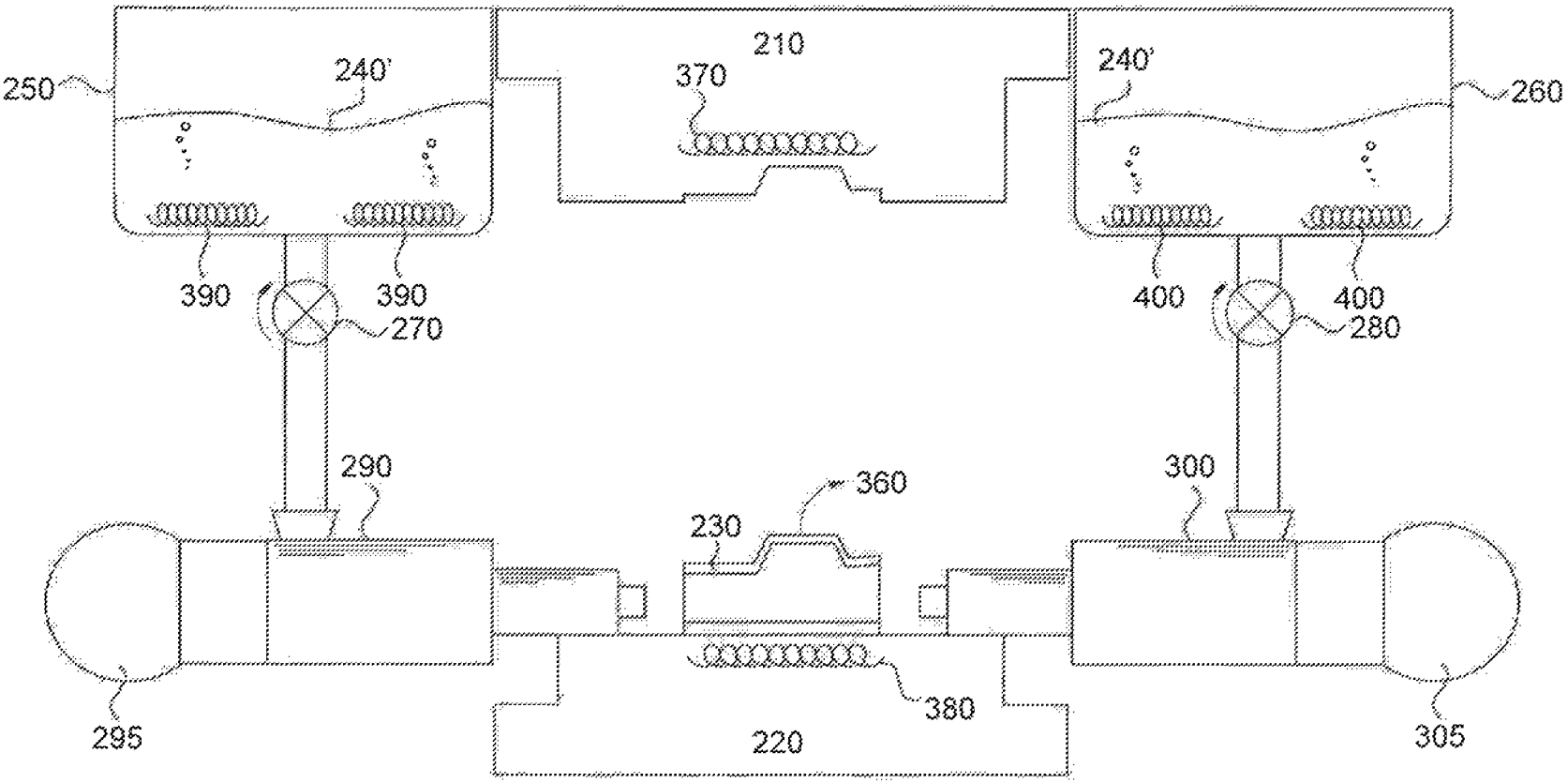
FIG. 30 is a cross-sectional diagram indicating a step S2110 of the flowchart of FIG. 1, consistent with an embodiment of the present disclosure.

Reference is now made to FIG. 30, a cross-sectional diagram of the apparatus for shaping a metal, corresponding to step S2110 of the flowchart of FIG. 21, consistent with an embodiment of die present disclosure. As shown in FIG. 21 and FIG. 30, in step S2108, dies 210 and 220 are moved away from each other and a shaped blank 360 is taken front die dies.

Figure 31:
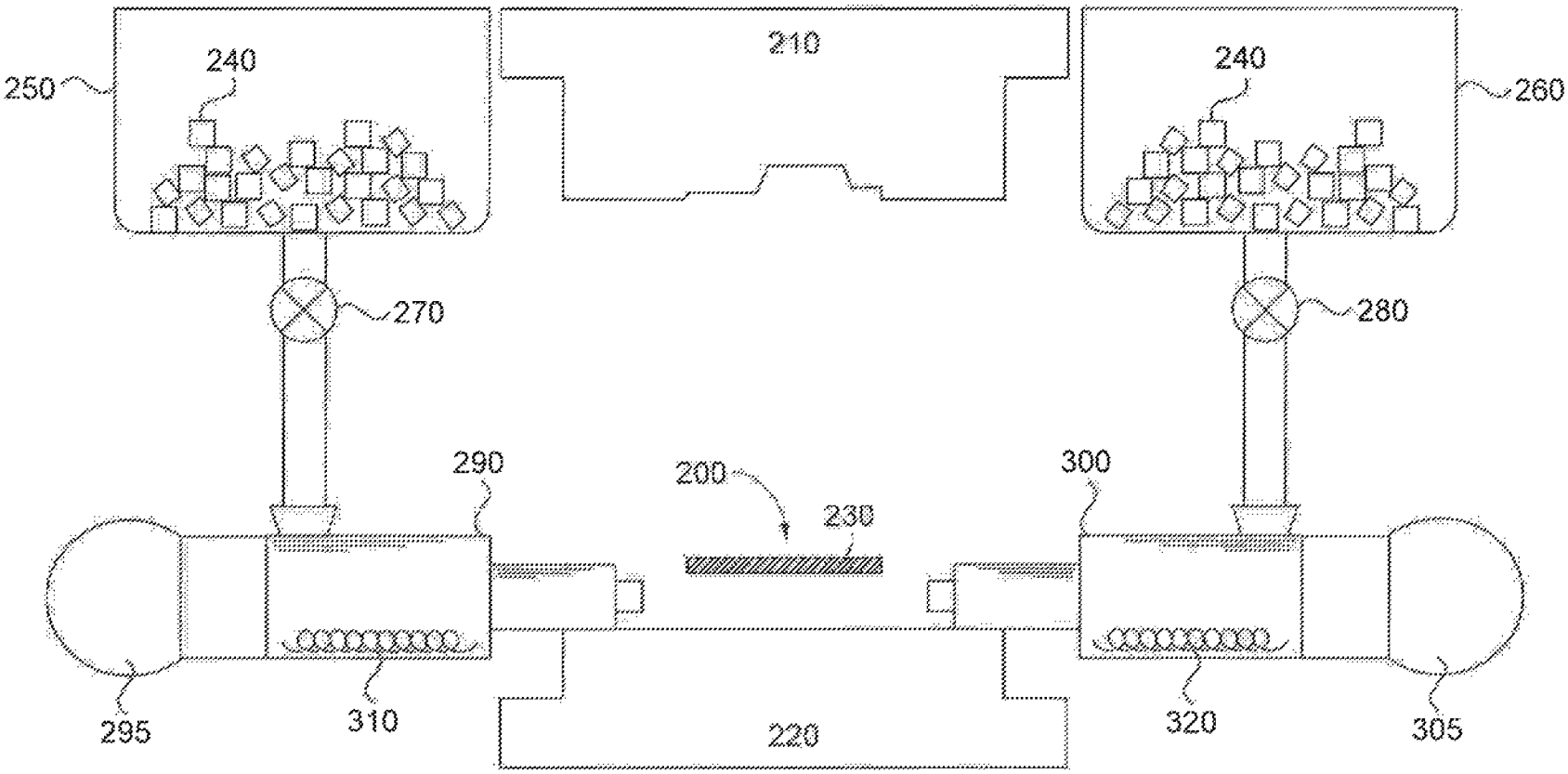
FIG. 31 is a cross-sectional diagram indicating a hyrdro-forming process applied to a blank sheet, consistent with an embodiment of the present disclosure.

Reference is now made to FIG. 31, a cross-sectional diagram indicating a hydroforming process applied to a blank sheet 230, consistent with an embodiment of die present disclosure. Blank sheet 230 can be mounted onto any one of dies 210 and 220, and the molten salt can be injected to a space inside the sealed dies, above or below the blank sheet.

Consistent with the above disclosure, the hydroforming apparatus applied pressurized molten salt to press the blank to make the blank malleable. In this way, the blank can completely contact the die without generating any cracks. Also, this method forms a metal product at low cost.

While the present invention has been described in connection with various embodiments, other embodiments of the inversion will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A method of shaping a blank, the method comprising:

loading a blank onto a first die;

assembling the first die together with a second die to form a seal around the blank;

activating a first heater included in at least one of the first die or the second die to soften the blank;

transferring solid salt from a salt container to a hydraulic cylinder;

forming a molten salt by activating a second heater associated with the hydraulic cylinder; and injecting the molten salt from the hydraulic cylinder into a space between the blank and the second die to supply hydraulic pressure to the blank so as to force the blank against an inner surface of the first die.

2. The method of claim 1, wherein the injecting further comprises pressurizing and pumping the molten salt into the space.

3. The method of claim 1, wherein the blank is loaded onto the first die using a robotic arm.

4. The method of claim 1, wherein a temperature of the molten salt is greater than 800° C.

5. The method of claim 1, wherein assembling the first die together with the second die comprises positioning the first and second dies in a hydroforming apparatus.

6. The method of claim 1, wherein the first heater is heated to a temperature within 100° C. of a deformation temperature of the blank.

7. The method of claim 1, wherein the first heater is heated to a temperature within 50° C. of a deformation temperature of the blank.

8. The method of claim 1, wherein the blank comprises a metal selected from the group consisting of steel, titanium, nickel, aluminum, magnesium, and alloys thereof.

9. The method of claim 1, wherein the blank comprises a metal having a formability lower than that of stainless steel.

10. The method of claim 1, wherein the salt comprises at least one of chloride salt, fluoride salt, cryolite salt, hydroxide salt, nitrate salt, or cyanide salt.

11. The method of claim 1, wherein transferring the solid salt from the salt container to the hydraulic cylinder includes opening a valve that connects the salt container and the hydraulic cylinder.

12. The method of claim 1, wherein forcing the blank against the inner surface of the first die causes a shaped blank to be formed, and wherein the method further comprises:

moving the first die away from the second die; and removing the shaped blank from at least one of the first die and the second die.

13. The method of claim 1, wherein transferring the solid salt from the salt container to the hydraulic cylinder includes opening a valve that connects the salt container and the hydraulic cylinder.

14. The method of claim 1, wherein assembling the first die together with the second die includes moving the first die and the second die together to apply a force to the blank.

15. The method of claim 1, wherein assembling the first die together with the second die includes moving the first die and the second die together to pre-set positions.

16. An apparatus for shaping a blank, the apparatus comprising:

a first die and a second die;

a support structure attached to the first and second dies and configured to bring the first and second dies together to form a seal around the blank;

a first heater included in at least one of the first die or the second die, the first heater being configured to soften the blank when the first and second dies form the seal around the blank;

a salt container configured to hold solid salt;

a hydraulic cylinder configured to receive the solid salt from the salt container; and a second heater associated with the hydraulic cylinder, the second heater being configured to heat the solid salt form a molten salt;

wherein the hydraulic cylinder is configured to inject the molten salt into a space between the blank and the second die to supply hydraulic pressure to the blank so as to force the blank against an inner surface of the first die.

17. The apparatus of claim 16, wherein the first heater is included in the first die and wherein the apparatus further comprises a third heater included the second die, the third heater being configured to soften the blank when the first and second dies form the seal around the blank.

18. The apparatus of claim 16, further comprising a controller configured to monitor, display and control at least one of a temperature of the first heater.

19. The apparatus of claim 16, further comprising a valve that connects the salt container and the hydraulic cylinder, wherein transferring the solid salt from the salt container to the hydraulic cylinder includes opening the valve.

20. A product formed by the process of:

loading a blank onto a first die;

assembling the first die together with a second die to form a seal around the blank;

activating a first heater included in at least one of the first die or the second die to soften the blank;

transferring solid salt from a salt container to a hydraulic cylinder;

forming a molten salt by activating a second heater associated with the hydraulic cylinder; and injecting the molten salt from the hydraulic cylinder into a space between the blank and the second die to supply hydraulic pressure to the blank so as to force the blank against an inner surface of the first die to shape the blank;

wherein the product is formed at least in part using the shaped blank.

* * * * *